US006370802B1

(12) United States Patent
Boyer et al.

(10) Patent No.: US 6,370,802 B1
(45) Date of Patent: Apr. 16, 2002

(54) BACK-LIT FASCIA WITH SPRING LOADED FASCIA TENSIONER

(76) Inventors: John D. Boyer, 3759 St. Rt. 350, Lebanon, OH (US) 45036; Ronald W. Makstaller, 969 Springbrook Dr., Cincinnati, OH (US) 45224; S. Frank Gessner, 1633 Longbourne, Cincinnati, OH (US) 45230; Richard Scott Grimes, 2976 Wheatfield Dr., Cincinnati, OH (US) 45251; William R. Wedding, Five Orchard Ct., Cincinnati, OH (US) 45255

( * ) Notice: Subject to any disclaimer, the term of this patent is extended or adjusted under 35 U.S.C. 154(b) by 0 days.

(21) Appl. No.: 09/397,534

(22) Filed: Sep. 16, 1999

(51) Int. Cl.[7] ..... G09F 17/00
(52) U.S. Cl. ..... 40/603; 40/564; 160/378
(58) Field of Search ..... 40/564, 590, 603, 40/604; 38/102, 102.1, 102.91; 160/329, 378

(56) References Cited

U.S. PATENT DOCUMENTS

| | | | | | |
|---|---|---|---|---|---|
| 2,608,251 | A | * | 8/1952 | Heintzel | 160/378 |
| 3,831,304 | A | * | 8/1974 | Miller et al. | 40/604 |
| 4,193,235 | A | | 3/1980 | Cucchiara | |
| 4,265,039 | A | | 5/1981 | Brooks | 40/603 |
| 4,404,962 | A | * | 9/1983 | Zinn et al. | 126/676 |
| 4,441,269 | A | | 4/1984 | Dahl | 40/603 X |
| 4,452,000 | A | | 6/1984 | Gandy | 40/574 |
| 4,674,214 | A | | 6/1987 | Gandy | 40/603 |
| 4,692,847 | A | | 9/1987 | Gandy | |
| 5,040,586 | A | | 8/1991 | Hillstrom | 40/603 X |
| 5,044,102 | A | | 9/1991 | Finch et al. | 40/603 |
| 5,127,177 | A | | 7/1992 | Tanner | 40/603 |
| 5,245,773 | A | | 9/1993 | Snyder | 40/603 |
| 5,255,459 | A | | 10/1993 | Verret | 40/603 |
| 5,388,794 | A | * | 2/1995 | Wolff | 40/604 X |
| 5,570,525 | A | | 11/1996 | Paglieri et al. | 40/564 |
| 5,685,511 | A | * | 11/1997 | Ghany et al. | 40/604 X |
| 6,070,351 | A | * | 6/2000 | Verret | 40/603 |

FOREIGN PATENT DOCUMENTS

| | | | | |
|---|---|---|---|---|
| EP | 503705 | * | 9/1992 | 40/603 |

* cited by examiner

*Primary Examiner*—Brian K. Green
(74) *Attorney, Agent, or Firm*—Wood, Herron & Evans, LLP

(57) ABSTRACT

A sign frame assembly for supporting a flexible fascia. In one embodiment, a frame member extends in a first direction and has first and second bracket-mounting sections spaced apart from each other in the first direction. First and second brackets have inner and outer opposite ends. The inner end of the first bracket is attached to the first bracket-mounting section of the first frame member. The inner end of the second bracket are pivotally mounted to the second bracket-mounting section of the frame member. First and second elongated fascia attachment members are affixed respectively to the outer ends of the first and second brackets. A flexible fascia having oppositely disposed edges is connected to the first and second elongated members. A bias member is operatively disposed between the frame member and the second bracket such that the bias member exerts a rotational force on the second bracket in a direction tending to spread apart the elongated fascia attachment members and tension the flexible fascia therebetween. Additional embodiments utilizing biased pivotal fascia tension members are disclosed.

41 Claims, 16 Drawing Sheets

BACK-LIT FASCIA WITH SPRING LOADED FASCIA TENSIONER

FIELD OF THE INVENTION

The present invention generally relates to sign assemblies with flexible fascia members, and, more particularly, to improved tensioning apparatus for applying tension to flexible fascia members.

BACKGROUND OF THE INVENTION

In general, back-lit fascia signage is typically placed around the top of a building, canopy, or other structure to identify the name and product of a particular business. Businesses using such back-lit fascia signage include fast food chains, service stations, banks, grocery stores, and the like. The fascia cabinets are internally illuminated to back-light the graphics printed on the fascia.

The installation of the fascia cabinets begins by mounting a rectangular cabinet across one or more sides of the building. The cabinet framework is usually fabricated from aluminum and aluminum extrusions and is shipped in unitized sections ranging from four to twelve feet long. These cabinets are mounted side-by-side to the building fascia, abutting each other to collectively form a continuous open-faced cabinet prior to addition of the fascia. Depending on the cabinet height, one, two, or three horizontal rows of fluorescent lights are contained in the cabinets to uniformly back-light the fascia. For most applications, the cabinets are about one foot deep and one to five feet high. After the cabinet framework is installed, a continuous plastic fascia is attached to the front of the assembly of cabinets. The plastic fascia is made of a relatively soft, flexible, translucent vinyl and may be decorated with various graphics, colors, stripes, patterns, logos, printed words, and the like. Additionally, a transparent cover may be attached to the bottom of the cabinet to allow for down-lighting of the building facade.

During the initial installation, the plastic fascia is stretched over the cabinet framework, providing an aesthetically pleasing and tailored look to the fascia system. Over time, however, exposure to weather and sunlight and temperature fluctuations may cause the fascia to wrinkle or sag, rendering the fascia less aesthetically pleasing. Prior signage assemblies have used a variety of tensioning schemes to stretch the flexible fascia over the cabinet framework. However, these prior tensioning schemes were directed at stretching the flexible fascia only during the initial installation with a predetermined tensioning force. That is, if the flexible fascia sagged over time because of exposure to weather and sunlight, these prior tensioning schemes could not automatically compensate for the sagging by applying additional tension to the flexible fascia.

What is needed, therefore, is a means for providing active tension to the flexible fascia to compensate for sagging or wrinkles that may occur in the flexible fascia over time. That is, as the flexible fascia is exposed to weather and sunlight and temperature fluctuations, the tendency to sag or wrinkle will be eliminated or minimized by a system providing active tension to the flexible fascia.

SUMMARY OF INVENTION

The present invention is directed to a sign frame assembly adapted to support a flexible fascia having oppositely disposed edges. In accordance with the principles of the present invention, a frame member extends in a first direction and has first and second bracket-mounting sections spaced apart from each other in the first direction. First and second brackets have inner and outer opposite ends. The inner end of the first bracket is attached to the first bracket-mounting section of the first frame member. The inner end of the second bracket are pivotally mounted to the second bracket-mounting section of the frame member. First and second fascia attachment members are connected respectively to the outer ends of the first and second brackets. Each fascia attachment member is adapted to connect to the different oppositely disposed edges of the flexible fascia. A bias member is operatively disposed between the frame member and the second bracket such that the bias member exerts a rotational force on the second bracket in a direction tending to spread apart the first and second fascia attachment members. In one aspect of the invention a flexible fascia is connected to and spans between the first and second elongated members. Consequently, the rotational force applied by the bias member tensions the flexible fascia.

In one embodiment, the first and second fascia attachment members are elongated and have first and second fascia-clamping members with confronting surfaces between which the opposite edges of the flexible fascia are insertable for engagement by the confronting surfaces and positively held therebetween. In another embodiment, the first and second fascia attachment members are elongated and have an elongated recess with an opening along the length of the recess. A rod is inserted into the recess and one of the edges of the flexible fascia is wrapped around the rod. As such, the rod pinches the edge of the flexible fascia against a wall of the recess to hold the flexible fascia in place without the need for stitching or other forms of fastening.

In another aspect of the invention, a protective cover is placed over the sign frame assembly to protect the sign frame assembly form liquid ingress. The protective cover includes an outer lip extending outwardly beyond the exterior of the flexible sheet to cause liquid incident to the exterior of the protective cover to drip from the outer lip at a point spaced outwardly from the exterior of the flexible fascia. The sign frame assembly may also include a bottom cover attached to the underside of the sign frame assembly. This bottom cover may come in different varieties depending on the desired lighting effect. For instance, the bottom cover could be opaque to eliminate illumination of the space below the sign frame assembly. Alternatively, the bottom cover may be translucent and may contain a series of apertures to permit illumination of the space below the sign frame assembly. To that end, at least one illumination source may be affixed to the interior of the sign frame assembly to illuminate the flexible fascia from the interior side. Additional illumination sources may be included in the sign frame assembly to accommodate signs of greater size. Suitable illumination sources included flourescent tubes, high intensity discharge lamps, and the like. Nevertheless, the sign frame assembly can be installed without employing any illumination sources to back-light the flexible fascia.

In one preferred embodiment, the sign frame assembly includes a second frame member also extending in the first direction and spaced apart from the first frame member. Like the first frame member, the second frame member is operatively connected to the inner ends of the third and fourth brackets substantially like first and second brackets.

DETAILED DESCRIPTION OF DRAWINGS

Figure 17A:
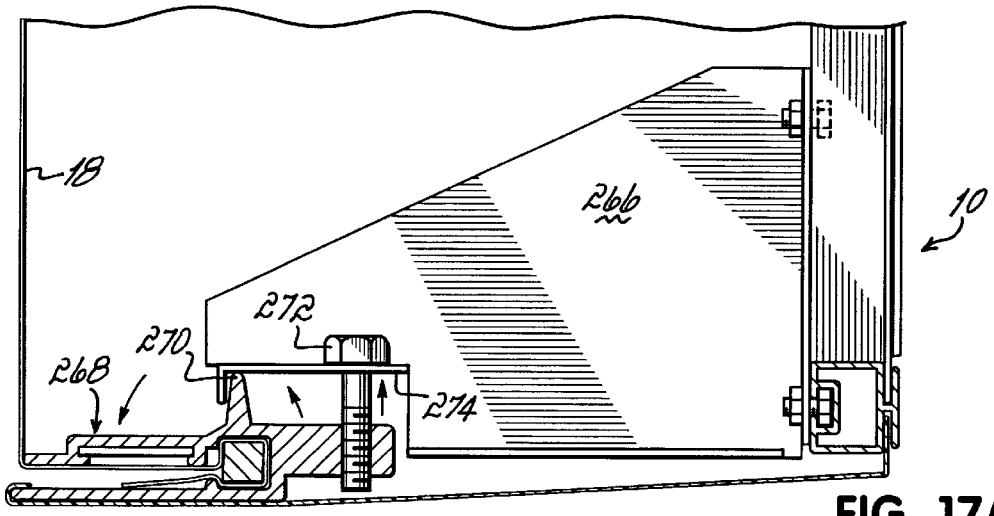
Figure 17B:
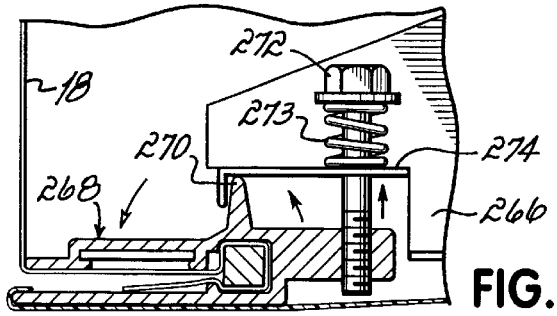
Figure 16A:
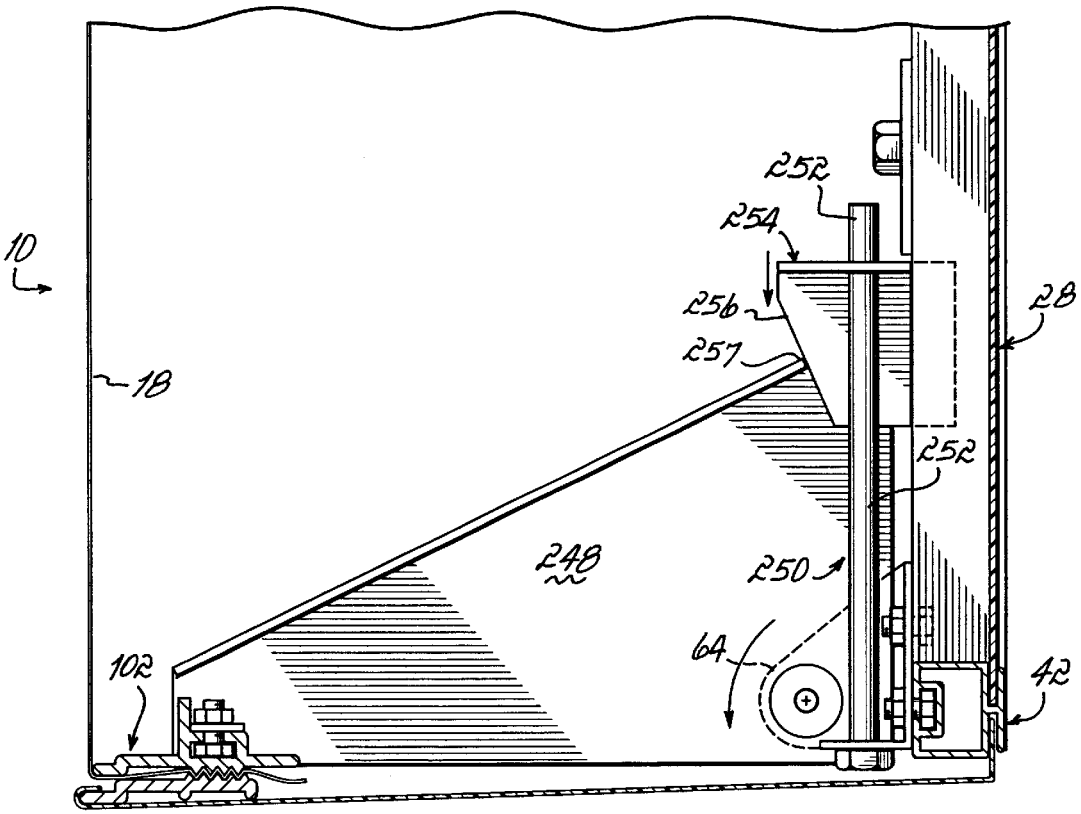
Figure 16B:
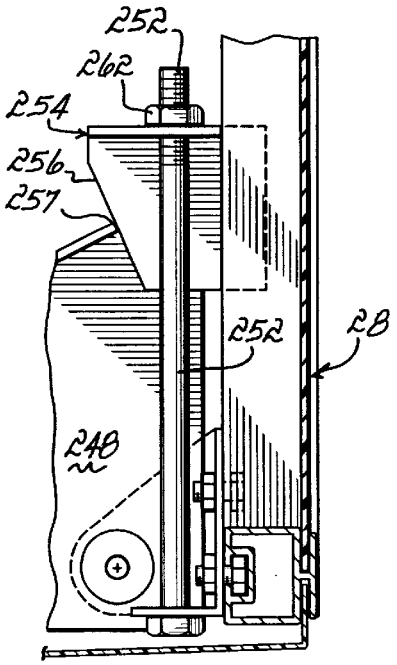
Figure 16C:
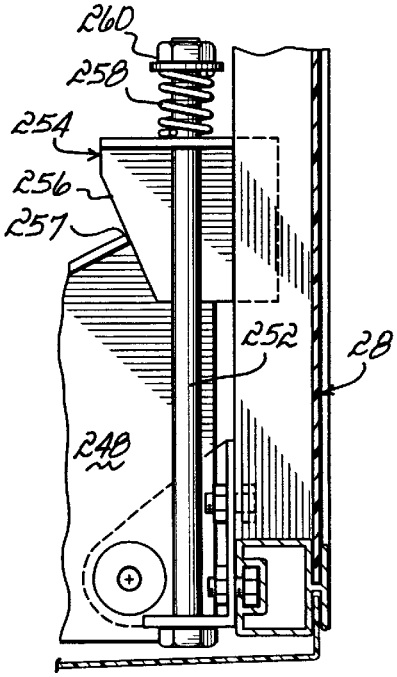
Figure 18:
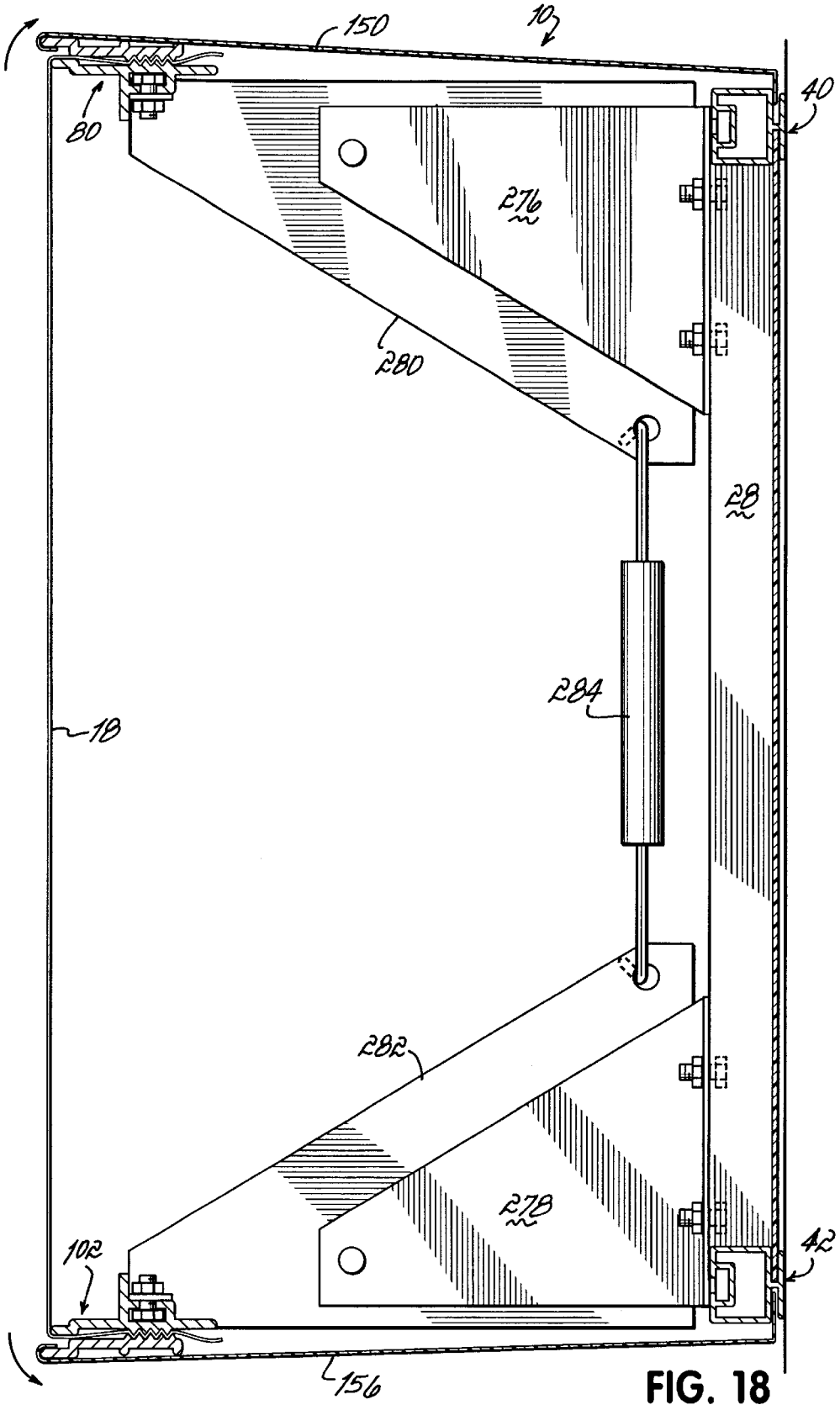
Figure 19:
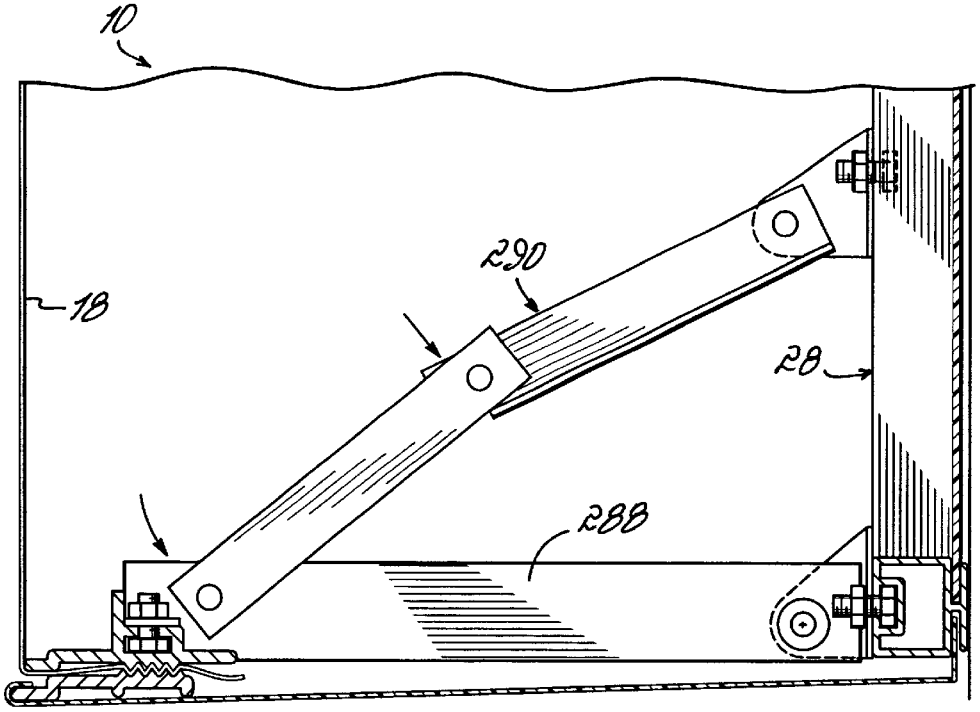
Figure 21:
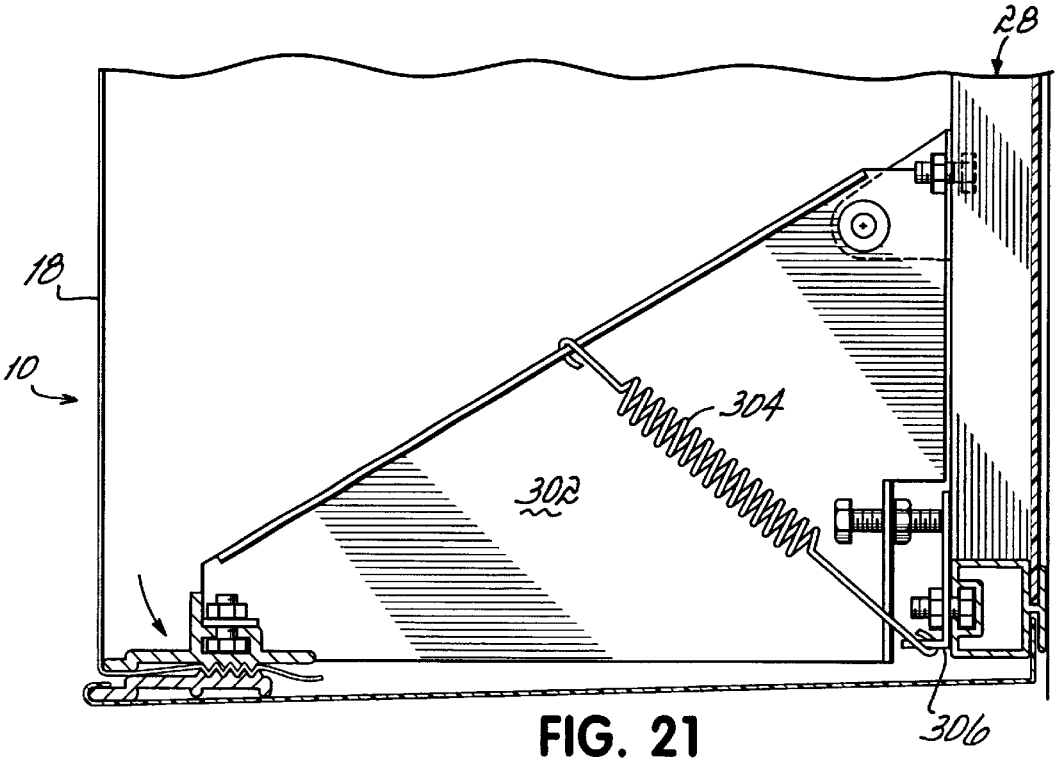
Figure 20:
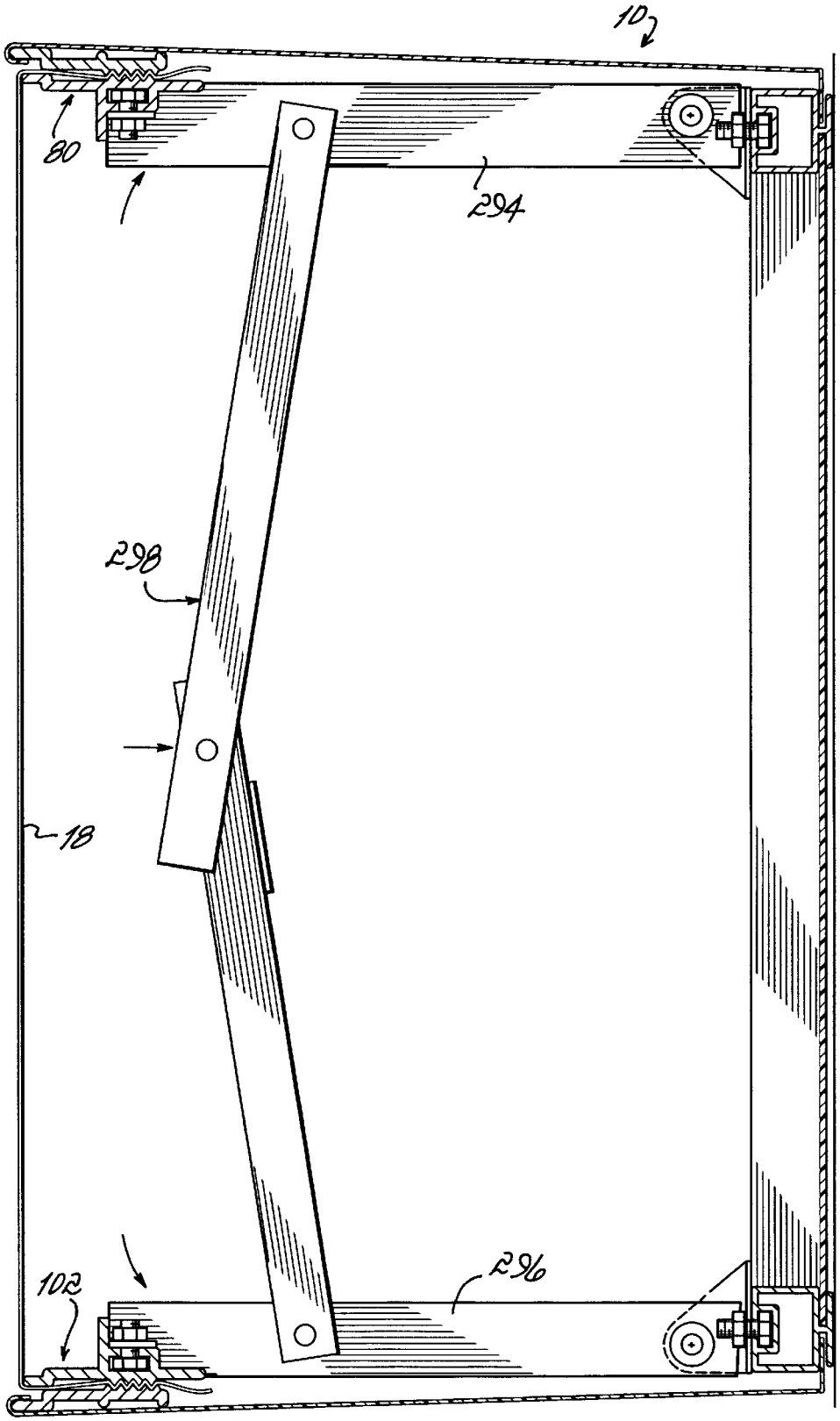

FIGS. 16A, 16B, and 16C are schematic cross-sectional views of another embodiment of the fascia tensioning mechanism of the sign frame assembly;

FIGS. 17A and 17B are schematic cross-sectional view of another embodiment of the fascia tensioning mechanism of the sign frame assembly;

FIG. 18 is a schematic cross-sectional view of another embodiment of the fascia tensioning mechanism of the sign frame assembly;

FIG. 19 is a schematic cross-sectional view of another embodiment of the fascia tensioning mechanism of the sign frame assembly;

FIG. 20 is a schematic cross-sectional view of another embodiment of the fascia tensioning mechanism of the sign frame assembly; and FIG. 21 is a schematic cross-sectional view of another embodiment of the fascia tensioning mechanism of the sign frame assembly.

DETAILED DESCRIPTION OF PREFERRED EMBODIMENTS

Figure 1:
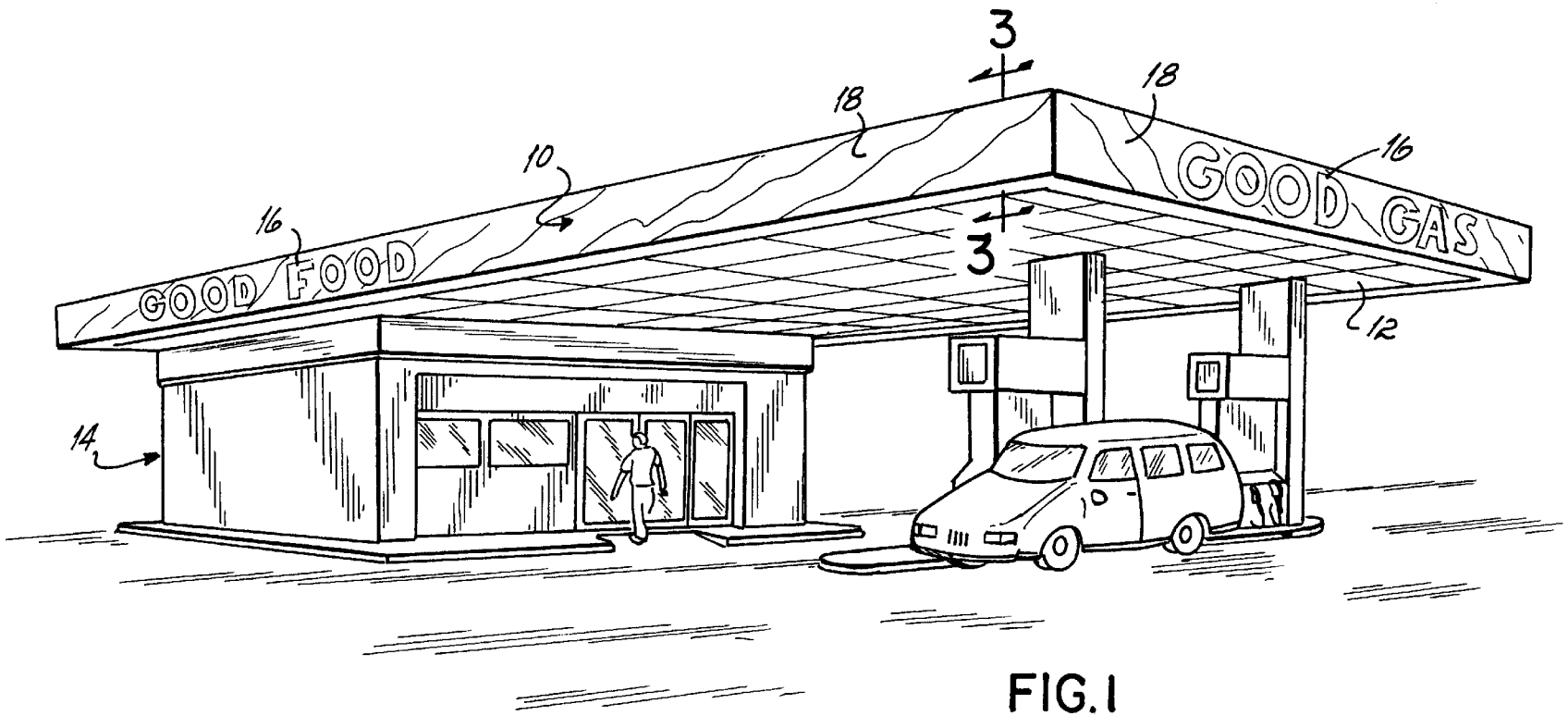
FIG. 1 is a perspective view of the sign frame assembly constructed according to a preferred embodiment in use on a canopy at a service station.

Referring first to FIG. 1, a sign frame assembly 10 constructed in accordance with the principles of the present invention is shown mounted to a canopy 12 providing shelter at a service station facility 14. For canopy mounting, the sign frame assembly 10 is attached to the vertical sides of the canopy structure on as many sides as are desired. Generally, the canopy structure is installed by one vendor and the sign frame assembly is attached by another vendor after the canopy installation is completed. Although the sign frame assembly 10 is illustrated for use by the service station facility 14, the sign frame assembly 10 can be adapted for use in a wide variety of situations, such as on the sides of fast food chains, banks, grocery stores, and the like, for example. As shown in FIG. 1, the sign frame assembly 10 preferably includes indicia 16 printed directly on a flexible fascia 18 forming the exterior front surface of the sign frame assembly 10. As explained in greater detail below, the sign frame assembly may be back-lit to illuminate the flexible fascia 18 and the indicia 16 printed thereon to more effectively promote the business name and services provided.

Figure 2:
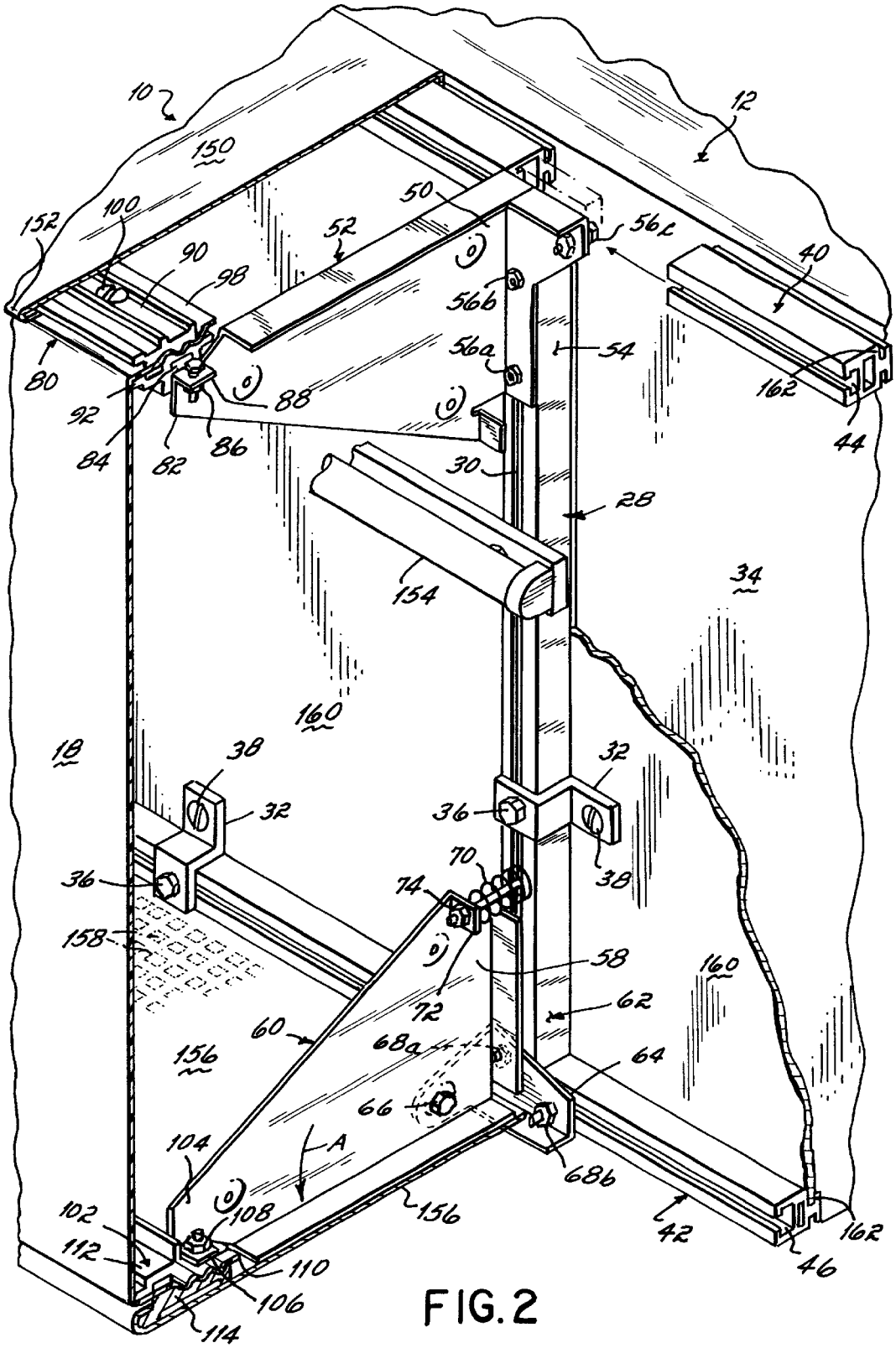
FIG. 2 is an enlarged partially cut-away perspective of the sign frame assembly.
Figure 3:
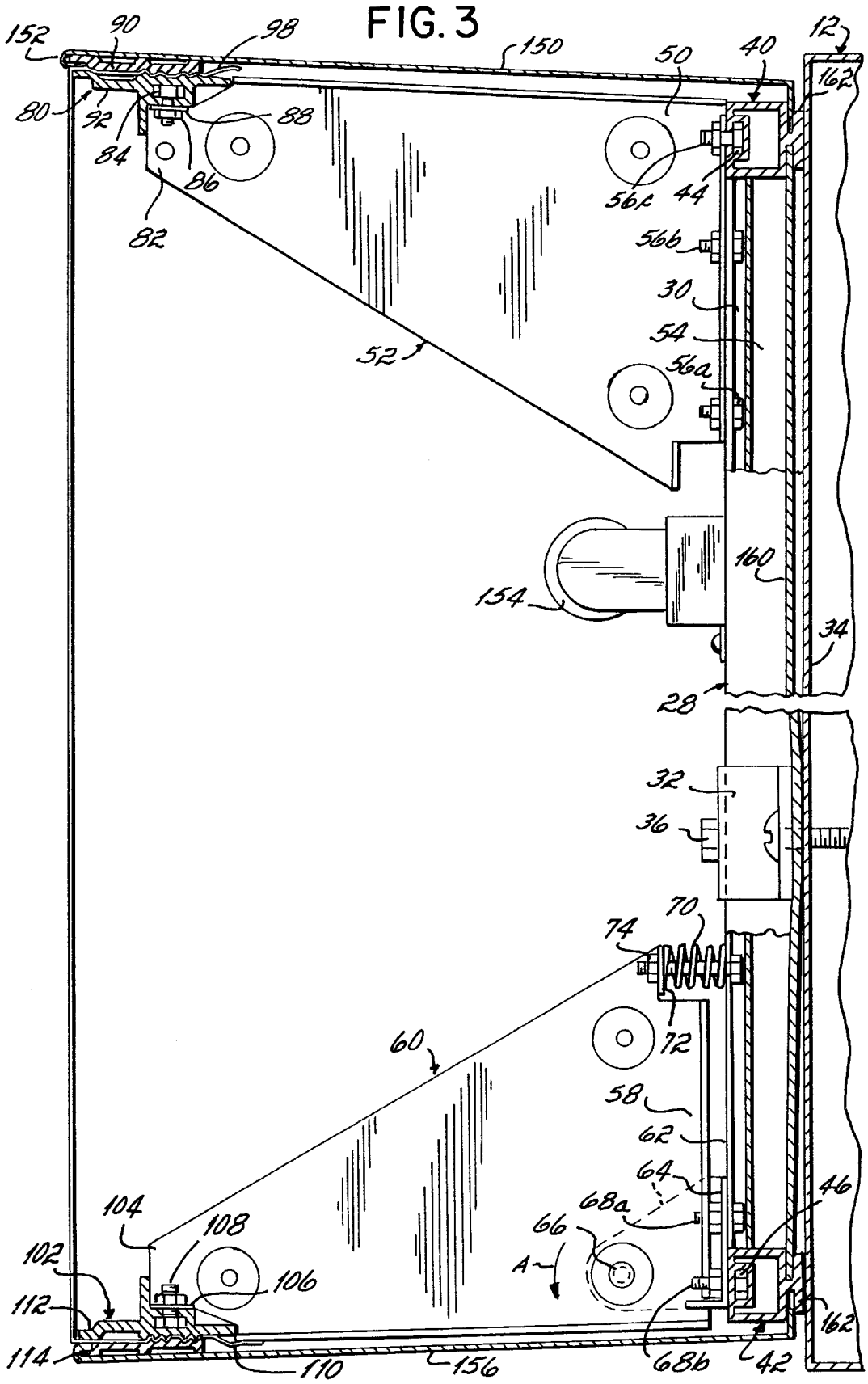
FIG. 3 is an enlarged cross-sectional view of the sign frame assembly taken along line 3—3 of FIG. 1.

Referring now to FIGS. 2 and 3, the sign frame assembly 10 includes a first or vertical frame member 28 with a channel 30 running along the longitudinal axis of the vertical frame member 28. The channel 30 is formed to receive and hold a bolt and more particularly a bolt head so that additional structures may be attached via the bolt to the vertical frame member 28. A Z-clamp 32 secures the vertical frame member to a mounting structure 34 such as that provided by the canopy 12 of FIG. 1. The Z-clamp 32 can be secured to the vertical frame member 28 and the mounting structure 34 by any suitable fastener such as bolt 36 or screw 38.

A first transverse frame member 40 extends substantially transverse to the longitudinal axis of the vertical frame member 28. The first transverse frame member 40 passes directly over the upper end of the vertical frame member 28. A second transverse frame member 42 substantially similar to the first transverse frame member 40 passes directly below the lower end of the vertical frame member 28. Channels 44, 46 extend respectively along the longitudinal axis of the first and second transverse frame members 40, 42 in substantially the manner as channel 30 extends along the vertical frame member 28. Accordingly, Z-clamps 32 secure the first and second transverse frame members 40, 42 to the mounting structure 34. The vertical frame member 28 and the first and second transverse frame members 40, 42 can be formed from any lightweight, structural material with suitable strength and corrosion resistance properties. Preferably, the frame members 28, 40, 42 are formed of extruded aluminum.

Additional vertical frame members (not shown) are spaced horizontally apart from vertical frame member 28. The vertical frame members 28 and the first and second transverse frame members 40, 42 work in combination to provide a suitable mounting framework from which the remainder of the sign frame assembly 10 is secured. To that end, an inner end 50 of a first or upper, generally triangularly shaped bracket 52 is affixed to a first or upper bracket mounting section 54 of the vertical frame member 28. The inner end 50 of the upper bracket 52 is secured to the channel 30 by bolts 56*a*, 56*b*. As is shown in FIGS. 2 and 3, a bolt 56*c* also secures the inner end 50 of the upper bracket 52 to the channel 44 in the first transverse frame member 40.

An inner end 58 of a second or lower, generally triangularly shaped bracket 60 is affixed to a second or lower bracket mounting section 62 of the vertical frame member 28. In accordance with the principles of the present invention, the lower bracket 60 is pivotally mounted to the lower bracket mounting section 62 of the vertical frame member 28, in contrast to the upper bracket 52 which is rigidly mounted to the upper bracket mounting section 54. More particularly, lower bracket 60 is pivotally attached to a mounting plate 64 via pivot member 66. The mounting plate 64 is fixedly attached to both the vertical frame member 28 and the second transverse frame member 42 via bolts 68*a*, 68*b*, respectively. A bias member 70 is secured to channel 30 of the vertical frame member 28 and to a flange portion 72 by means of bolt 74. As used in this specification, the term "biasing member" or any variation thereof means a component exerting a force, either attractive or repulsive, between two other components, i.e., tending to pull together or push apart the two other components. Preferably, the bias member is a compression member or spring. The bolt 74 is adjusted so that the bias member 70 is partially compressed between the vertical frame member 28 and the flange portion 72. Accordingly, the bias member 70 exerts a rotational force of the flange portion 72 and therefore the lower bracket 60 tending to rotate the lower bracket 60 away from the vertical frame member 28 as shown by arrow A (FIG. 3). As will be explained in greater detail below, the rotation of the lower bracket 60 actively applies tension to the flexible fascia 18 to keep the flexible fascia 18 in a stretched condition even through extended exposure to sunlight and temperature fluctuations. Additional upper and lower brackets (not shown) are similarly attached to the other spaced apart vertical members (not shown).

Figure 4:
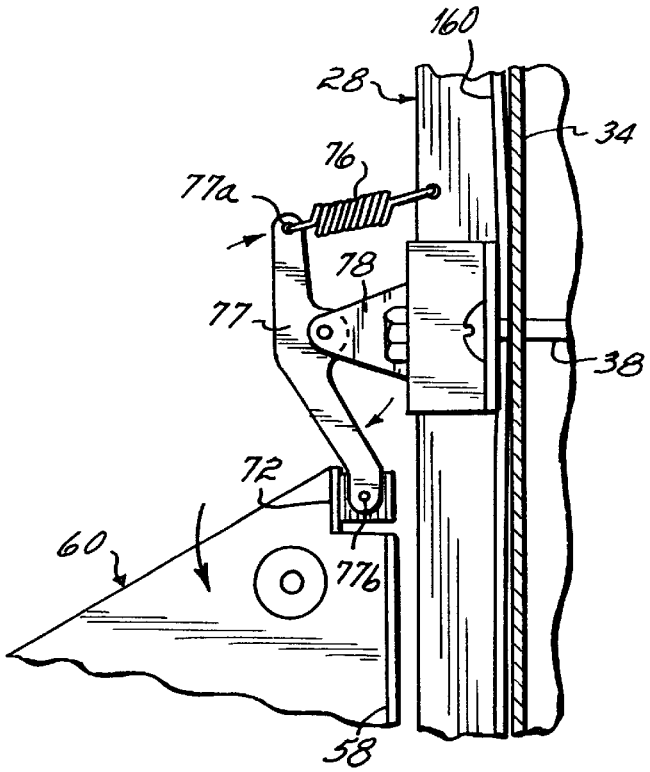
FIG. 4 is an enlarged partial cross-sectional view of the sign frame assembly using a tension member.

FIG. 4 shows an alternate structure for exerting rotational force onto the lower bracket 60. In this configuration, a tension member 76 replaces bias or compression member 70 illustrated in FIG. 3. The tension member 76 is connected to the vertical frame member 28 and one end 77*a* of a lever arm 77. The lever arm 77 is pivotally attached to a fixed lug 78 such that the other end 77*b* of the lever arm 77 engages the flange portion 72 of the lower bracket 60. As such, the tension member 76 exerts a rotational force onto the lower bracket 60 so as to tension the flexible fascia 18. It can be appreciated that a wide variety of configurations could be utilized to apply a rotational force to the lower bracket 60 to tension the flexible fascia 18. For instance, a torsion spring could be employed to apply rotational force to the lower bracket 60.

As an alternative to rigidly mounting upper bracket 52 to the upper bracket mounting section 54, upper bracket 52 can be pivotally mounted to the upper bracket mounting section 54 much like lower bracket 60 is pivotally mounted to the lower bracket mounting section 62. In this configuration, a bias member 70, associated with pivotally mounted upper bracket 52, exerts a rotational force on the upper bracket 52 tending to rotate the upper bracket 52 away from the vertical frame member 28. Accordingly, upper bracket 52 and lower bracket 60 are forced away from each other by their respective bias members 70 apply tension to the flexible fascia 18. It will also be appreciated that the lower bracket 60 can be rigidly mounted to the lower bracket mounting section 62 and only the upper bracket 52 is pivotally mounted to the upper bracket mounting section 54. In this configuration, the upper bracket is solely responsible for tensioning the flexible fascia 18.

Figure 5:
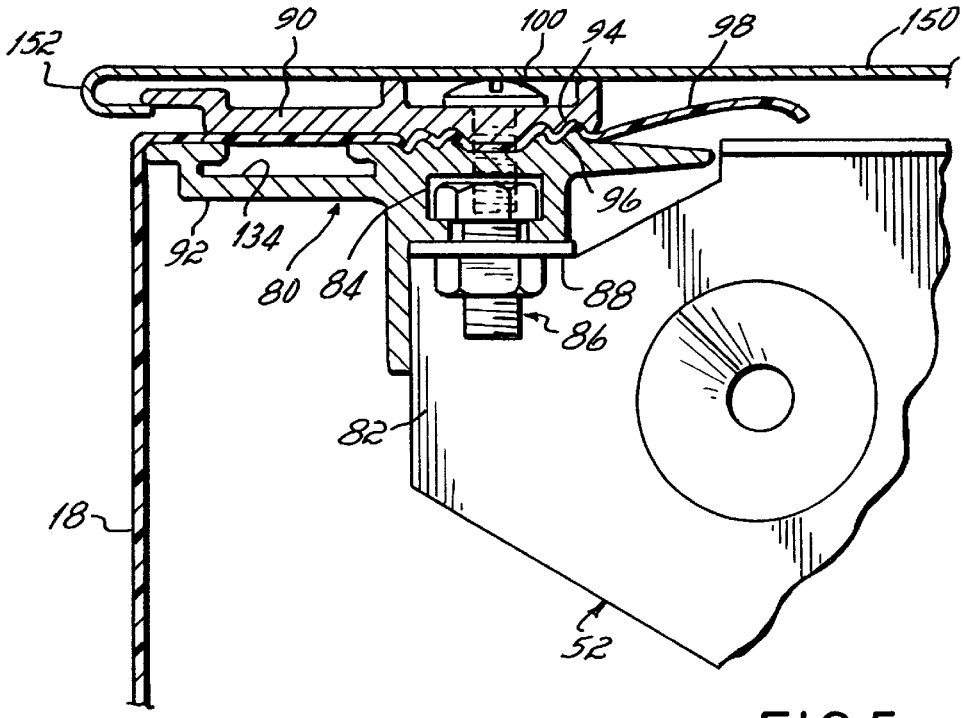
FIG. 5 is an enlarged partial cross-sectional view of the upper fascia attachment member of FIG. 3.

A first or upper fascia attachment member 80 is affixed to an outer end 82 of the upper bracket 52. The upper fascia attachment member 80, preferably elongated, has a channel 84 formed to receive and hold a bolt and more particularly a bolt head in much the same fashion that channels 30, 44, 46 function. As such, a bolt 86 or some other suitable fastener is held in channel 84 and is secured to flange portion 88 at the outer end 82 of the upper bracket 52. As is clearly shown in FIG. 5, the upper fascia attachment member 80 has first and second fascia-clamping members 90, 92 each having respective confronting surfaces 94, 96. A first edge 98 of the flexible fascia 18 is inserted between and engaged by the confronting surfaces 94, 96 to positively hold the first edge 98. The first and second fascia-clamping members 90, 92 are clampingly held together along their length by fasteners 100.

In a similar fashion, a second or lower fascia attachment member 102 is affixed to an outer end 104 of the lower bracket 60. The lower fascia attachment member, preferably elongated, is constructed substantially like upper fascia attachment member 80. Likewise, the lower fascia attachment member 102 is attached to a flange portion 106 of lower bracket 60 by bolt 108. A second opposite edge 110 of the flexible fascia 18 is clampingly engaged by first and second fascia-clamping members 112, 114 of the lower fascia attachment member 102. As such, the flexible fascia 18 stretched between the upper and lower fascia attachment members 80, 102 covers the exterior most portion of the sign frame assembly 10.

As was briefly described above, the lower bracket 60 is pivotally connected to mounting plate 64. The bias member 70 exerts a rotational force onto the lower bracket 60 which tends to move the lower bracket 60 and hence lower fascia attachment member 102 away from upper fascia attachment member 80. Therefore in accordance with the principles of the present invention, the flexible fascia 18, which spans between the upper and lower fascia attachment members 80, 102, is tensioned by the rotational force exerted by the bias member 70. Because the bias member 70 constantly applies a rotational force to the lower bracket 60, the flexible fascia 18 is actively tensioned throughout the service life of the sign frame assembly 10. Accordingly, the flexible fascia remains in a stretched and aesthetically pleasing condition throughout prolonged exposure to sunlight, moisture, temperature fluctuations and the like.

Figure 6:
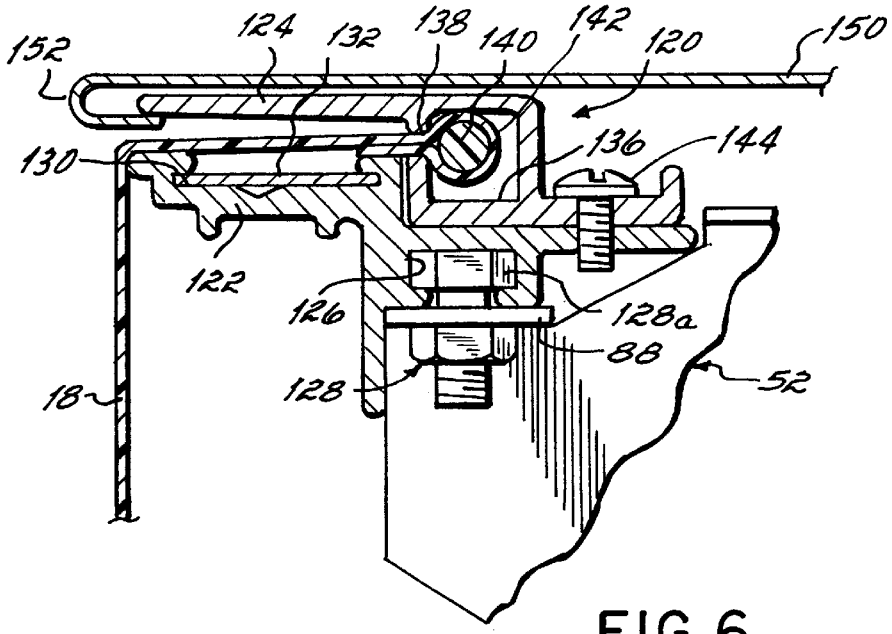
FIG. 6 is an enlarged partial cross-sectional view similar to that of FIG. 5 of another embodiment of a fascia-clamping member.
Figure 7:
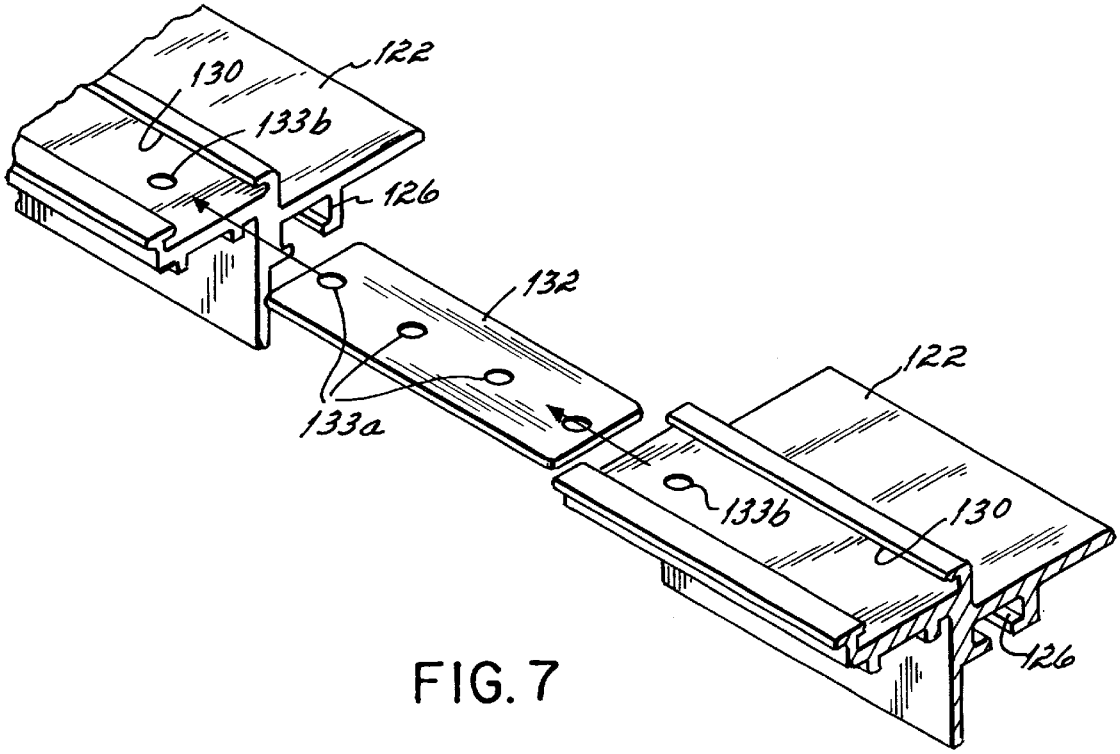
FIG. 7 is an enlarged prospective view of the outer elongated members adapted to receive a splicing plate.

With reference to FIG. 6, an alternate upper fascia attachment member 120 having a bracket connecting member 122 and a fascia retaining member 124 is shown. The bracket connecting member 122 has a first channel 126 which is formed to receive and hold a bolt 128 and more particularly a bolt head 128*a* so that the bracket connecting member can be secured to flange portion 88 of upper bracket 52. The bracket connecting member 122 further includes a second channel 130 formed to receive a splicing plate 132. As illustrated in FIG. 7, the splicing plate 132 assists in aligning two abutting bracket connecting members 122. After the two bracket connecting members 122 are aligned and abutted, they can be fixedly secured to one another by inserting a suitable fastener through holes 133*a* in the splicing plate and through holes 133*b* in the bracket connecting members 122. The second fascia-clamping member 92 (FIG. 5) also includes a channel 134 which is adapted to receive and hold a splicing plate 132.

The fascia retaining member 124 includes an elongated recess 136 with an opening 138 along the length of the recess 136. Inserted within the recess 136 is a rod 140 with a substantially circular cross section. An end portion 142 of the flexible fascia 18 is wrapped around the rod 140. As such, the end portion 142 is secured around the rod 140 as the end portion 142 is pinched and retained between the rod 140 and opposing sides of the opening 138. It can be appreciated that an elongated member substantially the same as the upper fascia attachment member 120 may be affixed to the outer end 104 of lower bracket 60 to secure the flexible fascia 18. The fascia retaining member 124 is secured to the bracket connecting member 122 by a series of fasteners 144 along their respective lengths. It will be appreciated that the rod 140 can have a non-circular cross-section such as a square or rectangular cross-section.

As an alternative to the fascia attachment scheme described above, the rod 140 is directly affixed to the outer ends 82, 104 of respective upper and lower brackets 52, 60. More specifically, the rod 140 is secured with suitable fasteners to flange portions 88, 106 and respective upper and lower brackets 52, 60. The fascia 18 is secured to the rod 140 by wrapping the end portion 142 around the rod 140 and sewing or welding it to the fascia 18. Cut-outs or notches are provided in the end portion 142 so that the end portion 142 will not interfere with the connection of the rod 140 to the outer ends 82, 104 of upper and lower brackets 52, 60.

With reference to FIGS. 2 and 3, the sign frame assembly 10 further includes a protective cover 150 placed over the sign frame assembly 10 to protect the sign frame assembly 10 from liquid ingress, such as rain water. The protective cover 150 includes an outer lip 152 that extends outwardly beyond the exterior of the flexible fascia 18 to cause liquid incident on the exterior of the protective cover 150 to drip from the outer lip 152 at a point spaced outwardly from the exterior of the flexible fascia. As such, the flexible fascia 18 should remain relatively free of rain water which may otherwise detract from the sign's appearance.

As shown in FIGS. 2 and 3, the sign frame assembly further includes an illumination source 154 for illuminating the flexible fascia 18 from its interior side. The illumination source 154 is attached to and spans between the vertical frame members 28. The illumination source 154 can be any known illuminating device such as flourescent lighting or High Intensity Discharge (HID) lamps. Additional illumination sources may be included in the interior of the sign frame assembly 10 as the vertical height of the sign frame assembly 10 increases. It will be appreciated that the sign frame assembly may be installed without the inclusion of an illumination source 154 to back-light the flexible fascia 18. In this configuration, the flexible fascia 18 may be lighted by an external illumination source.

The sign frame assembly 10 also includes a bottom cover 156 affixed to the bottom of the sign frame assembly 10. The bottom cover 156 may come in different configurations depending on the desired lighting effect. For instance, the bottom cover 156 may be opaque to eliminate illumination of the space below the sign frame assembly. The bottom cover 156 may also be translucent to permit illumination of the space below the sign frame assembly 10. Alternatively and as shown in FIG. 2, the bottom cover 156 is translucent and has a series of small apertures 158 (as shown in phantom lines) in a grid pattern to permit additional light through the bottom cover 156.

In addition to the protective covers 150, 156 on the top and bottom of the sign frame assembly 10, a rear cover 160 is also secured to the rear portion of the sign frame assembly 10. More specifically, the rear cover 160, preferably a thin, sheet material, is inserted during the installation of the sign frame assembly 10 into slots 162 running along the length of the vertical frame member 28 and the first and second transverse frame members 40, 42. The rear cover 160 is held in place by the slots 162 such that no fasteners are necessary.

The flexible fascia 18 is preferably made from a relatively soft, flexible, translucent vinyl. The flexible nature allows the flexible fascia to be readily stretched and maintained in a taut condition. The translucent nature permits back-lit illumination of the graphics, patterns, logos or indicia printed on the exterior of the flexible fascia 18. Because the flexible fascia 18 is detachably affixed to the sign frame assembly 10, a flexible fascia 18 with different graphics and indicia can easily replace the originally installed flexible fascia with minimal effort.

It will be appreciated that the various dimensions of the sign frame assembly 10 can vary depending on the application. It is contemplated that the sign frame assembly 10 will be approximately one foot deep and approximately one to five feet in height. To provide for more efficient installation, unitized sections of the sign frame assembly may be fabricated off-site and brought to the job site for installation onto the prepared support structure such as the canopy 12 shown in FIG. 1. These unitized sections can vary in size from four to twelve feet long.

The present invention also contemplates a method for constructing these unitized sections of sign frame assembly 10. While the construction process is described relevant to a particular order of steps, other orders may be utilized to construct a unitized section of the sign frame assembly 10. Initially, the respective inner ends 50 of two spaced apart upper brackets 52 are mounted to the upper bracket-mounting sections 54 of two spaced apart vertical frame members 28. Next, the inner ends 58 of the two spaced apart lower brackets 60 are pivotally mounted respectively to two mounting plates 66 which are affixed to the lower bracket-mounting sections 62 of the two vertical frame members 28. The first and second transverse frame members 40, 42 are then operatively connected to the respective inner ends 50, 58 of the upper and lower brackets 52, 60 on each of the two vertical frame members 28. Next, upper and lower fascia attachment members 80,102 are connected to the respective outer ends 82, 104 of the upper and lower brackets 52, 60. The flexible fascia is then attached to and stretched between the upper and lower fascia attachment members 80, 102. Finally, the bias member 70 is disposed or placed between the lower bracket 60 and the vertical frame members 28. The bias member is adjusted so that it is in compression and therefore exerting a rotational force against the pivotally mounted lower bracket 60. Consequently, the lower bracket 60 tends to spread the upper and lower fascia attachment members 80, 102 apart and tension the flexible fascia 18. As described above, the unitized sections of the sign frame assembly 10 could be constructed such that the upper brackets 52 are pivotally mounted and the lower brackets 60 are rigidly mounted such that upper brackets 52 pivot to tension the flexible fascia 18. Similarly, both the upper and lower brackets 52, 60 could be pivotally mounted to effect tensioning of the flexible fascia 18.

At times, the length of the sign frame assembly 10 may need to be shorten to accommodate changes in the underlying mounting structure such as if the sign frame assembly 10 is moved to an entirely different building facade with different dimensions. The length of the sign frame assembly 10 can be shortened by simply shortening one of the unitized sections of the sign frame assembly 10. The configuration of the framing members making up the unitized sections lends itself to the quick and efficient shorten of the unitized section.

More specifically and as described above, first and second transverse members 40, 42 and upper and lower fascia attachment members 80, 102 each have respective channels 44, 46, 84 for slidingly receiving the heads of bolts 56*c*, 68*b*, 86, 108. Therefore, to shorten a section of the sign frame assembly, the bolts 56*c*, 68*b*, 86, 108 are loosened and the combination of the upper and lower brackets 52, 60 and the vertical frame member 28 are slid off the end of the first and second transverse members 40, 42 and upper and lower fascia attachment members 80, 102. Once this combination is removed, the first and second transverse members 40, 42 and upper and lower fascia attachment members 80, 102 can be cut to the appropriate length. Once the appropriate length is achieved the combination of the upper and lower brackets 52, 60 and the vertical frame member 28 can be slid back onto the ends of the first and second transverse members 40, 42 and upper and lower fascia attachment members 80, 102. Specifically, the heads of bolts 56*c*, 68*b*, 86, 108 are slid back respectively into channels 44, 46, 84. The bolts 56*c*, 68*b*, 86, 108 are then retightened, yielding a shortened unitized section and sign frame assembly 10. Because the channels 44, 46, 84 can slidingly receive bolts 56*c*, 68*b*, 86, 108 along the entire length of first and second transverse members 40, 42 and upper and lower fascia attachment members 80, 102, shortening of the sign frame assembly 10 can be accomplished quickly without the need to drill any additional holes in the frame work. In general, the first and second transverse members 40, 42 and upper and lower fascia attachment members 80, 102 can be readily shortened using a hacksaw or other similar saw.

Figure 8:
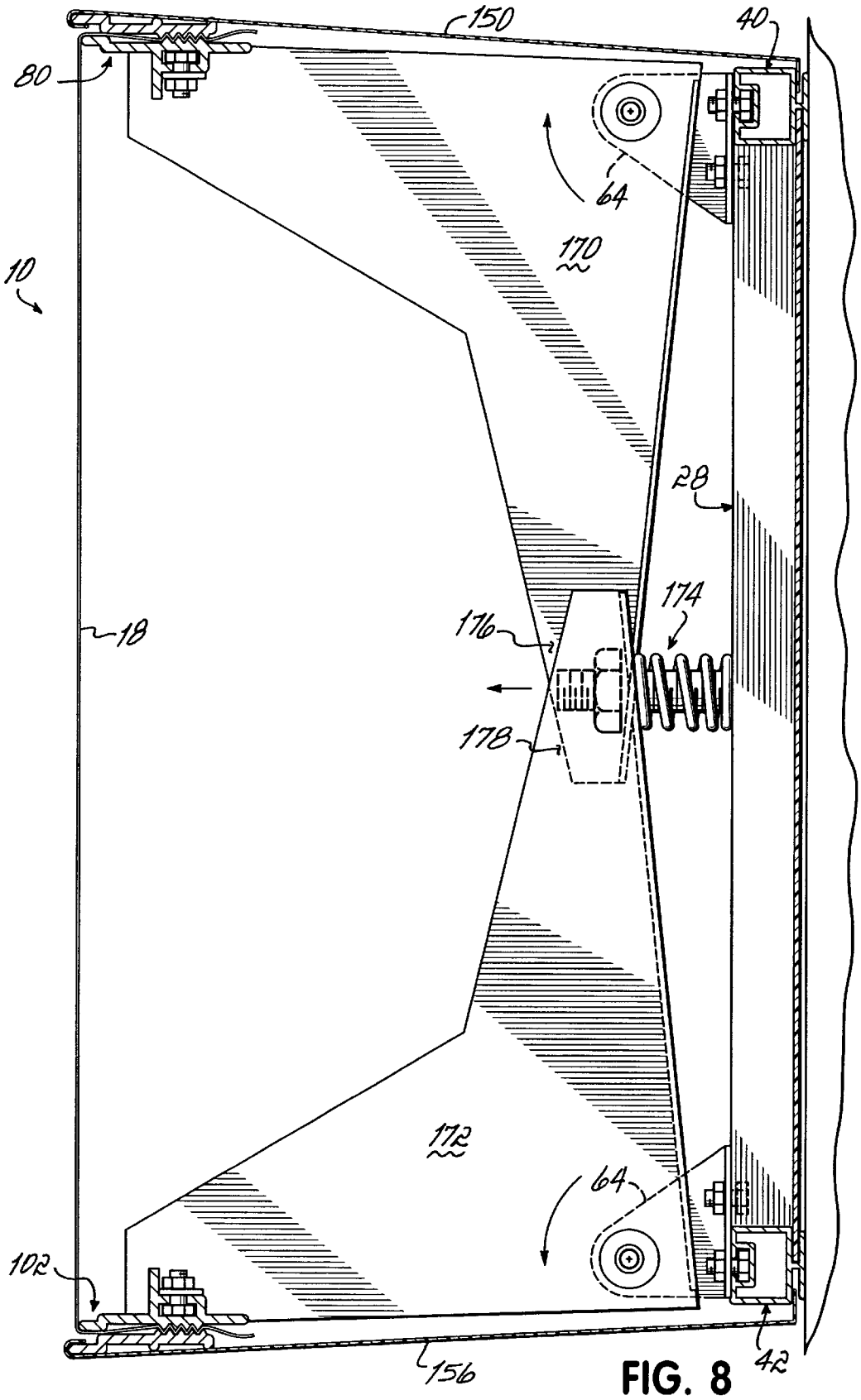
FIG. 8 is a schematic cross-sectional view of another embodiment of the fascia tensioning mechanism of the sign frame assembly.

As can be appreciated, various mechanical configurations can be used to apply tension to the flexible fascia 18. To that end and in accordance with the principles of the invention as described hereinabove, several alternative embodiments of the sign frame assembly 10 are described below. For example and with reference to FIG. 8, the sign frame assembly 10 is shown with upper and lower pivoting brackets 170, 172. A bias member 174 such as a compression spring engages overlapping extension arms 176, 178 of upper and lower pivoting brackets, 170, 172. The bias member 174 exerts a rotational force on the upper and lower pivoting brackets 170, 172 in a direction tending to tension the flexible fascia 18. As can be appreciated, the arms 176, 178 may be shortened and individual bias members 174 can be used independently to engage the arms 176 and 178. One benefit of using a single bias member 174 as shown in FIG. 8 is that it will tend to center the flexible fascia 18 about the vertical center line of the sign frame assembly 10, yielding a more aesthetically pleasing appearance.

Figure 9:
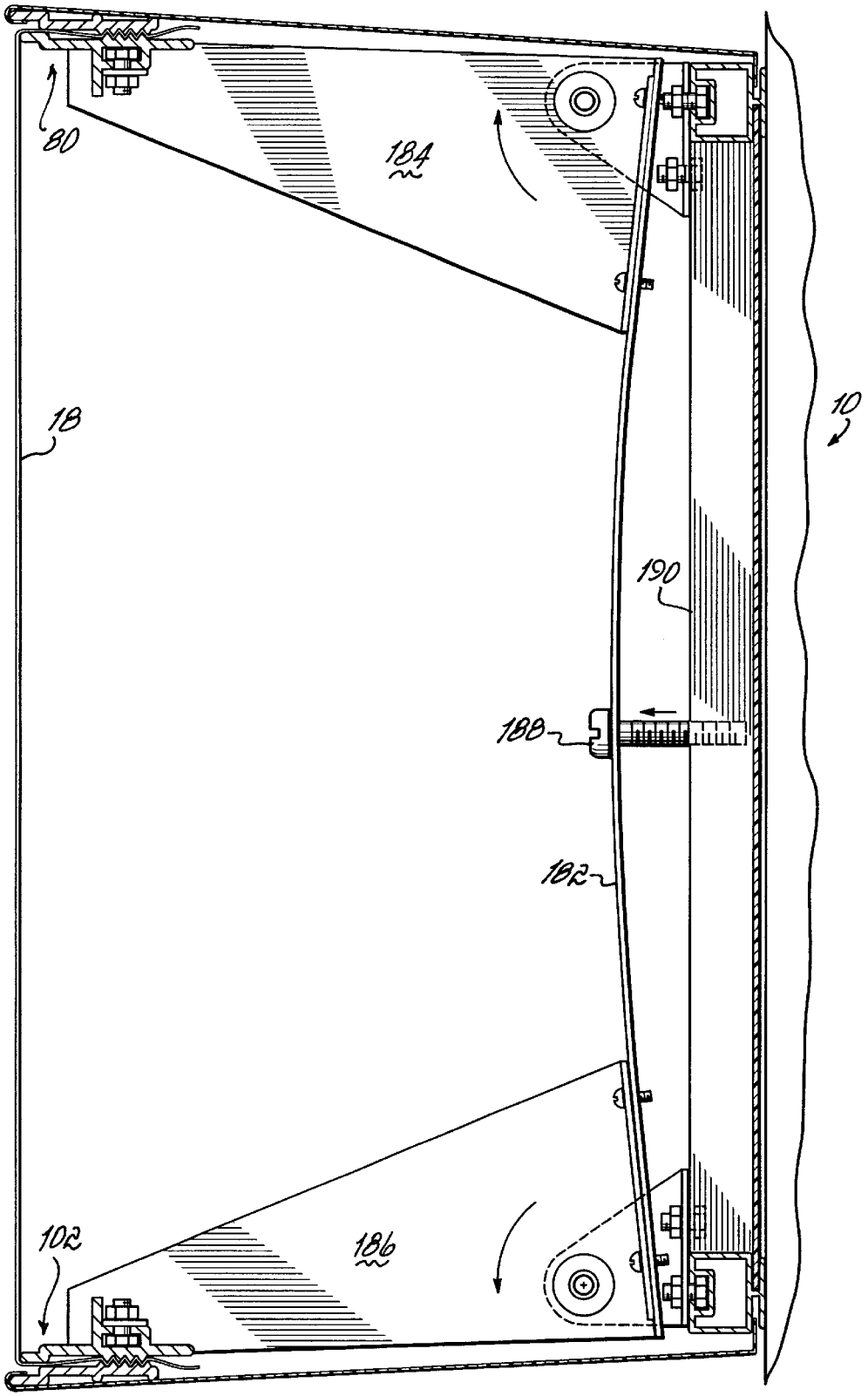
FIG. 9 is a schematic cross-sectional view of another embodiment of the fascia tensioning mechanism of the sign frame assembly.

With reference to FIG. 9, another embodiment of the sign frame assembly 10 is shown. A bias member 182, such as a leaf spring, is connected between upper and lower pivoting brackets 184, 186. A screw or bolt 188 resiliently secures the bias member 182 to a vertical frame member 190. As the screw 188 is tightened to move the bias member 182 toward the vertical frame member 190, the bias member 182 tends to straighten out and reduce the tension on the flexible fascia 18. Conversely, as the screw 182 is loosened and the bias member 182 bows outwardly, more tension is applied to the flexible fascia 18 as the upper and lower pivoting brackets 184, 186 tend to spread apart.

Figure 10:
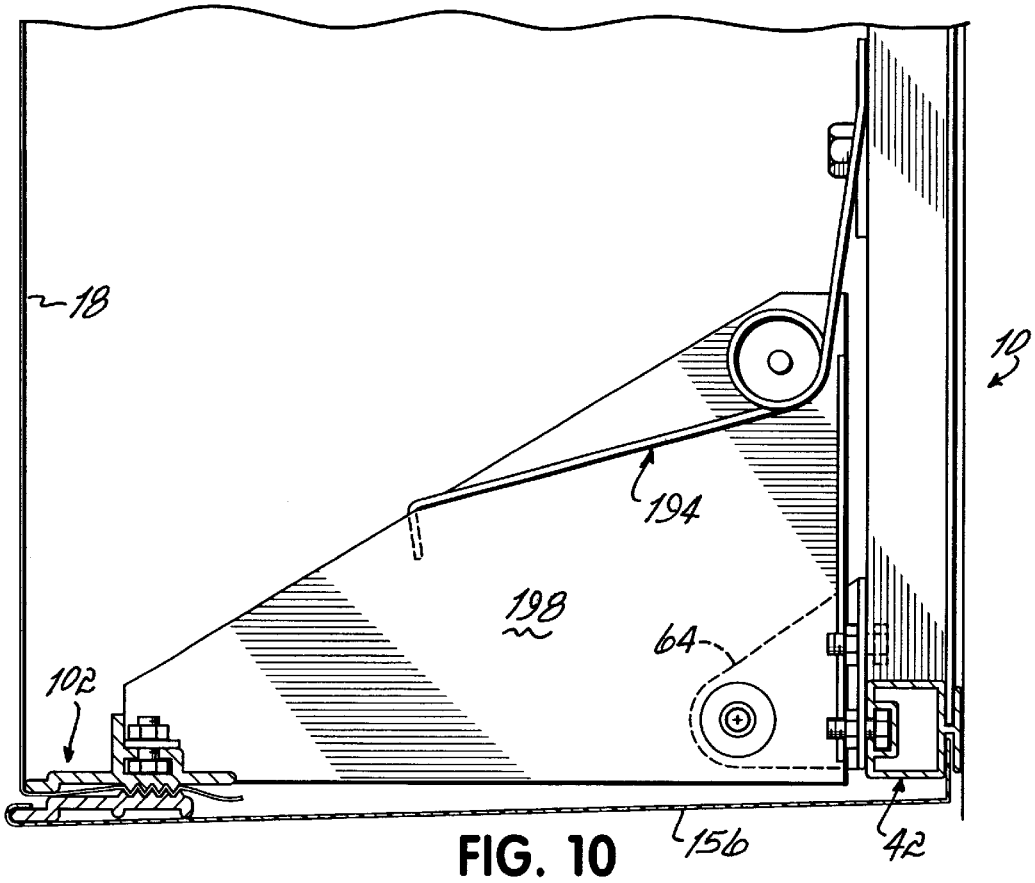
FIG. 10 is a schematic cross-sectional view of another embodiment of the fascia tensioning mechanism of the sign frame assembly.

The embodiment shown in FIG. 10 is very similar to the embodiment in FIG. 3. In this embodiment, a bias member 194 is connected between a vertical frame member 196 and a lower pivoting bracket 198 to exert a rotational force on the lower pivoting bracket 198 which tends to tension the flexible fascia 18. The bias member 194 is preferably a torsion spring. As can be appreciated, the torsion spring 194 could also be used on an upper pivoting bracket such that both the upper and lower pivoting brackets collectively apply tension to the flexible fascia 18.

Figure 11:
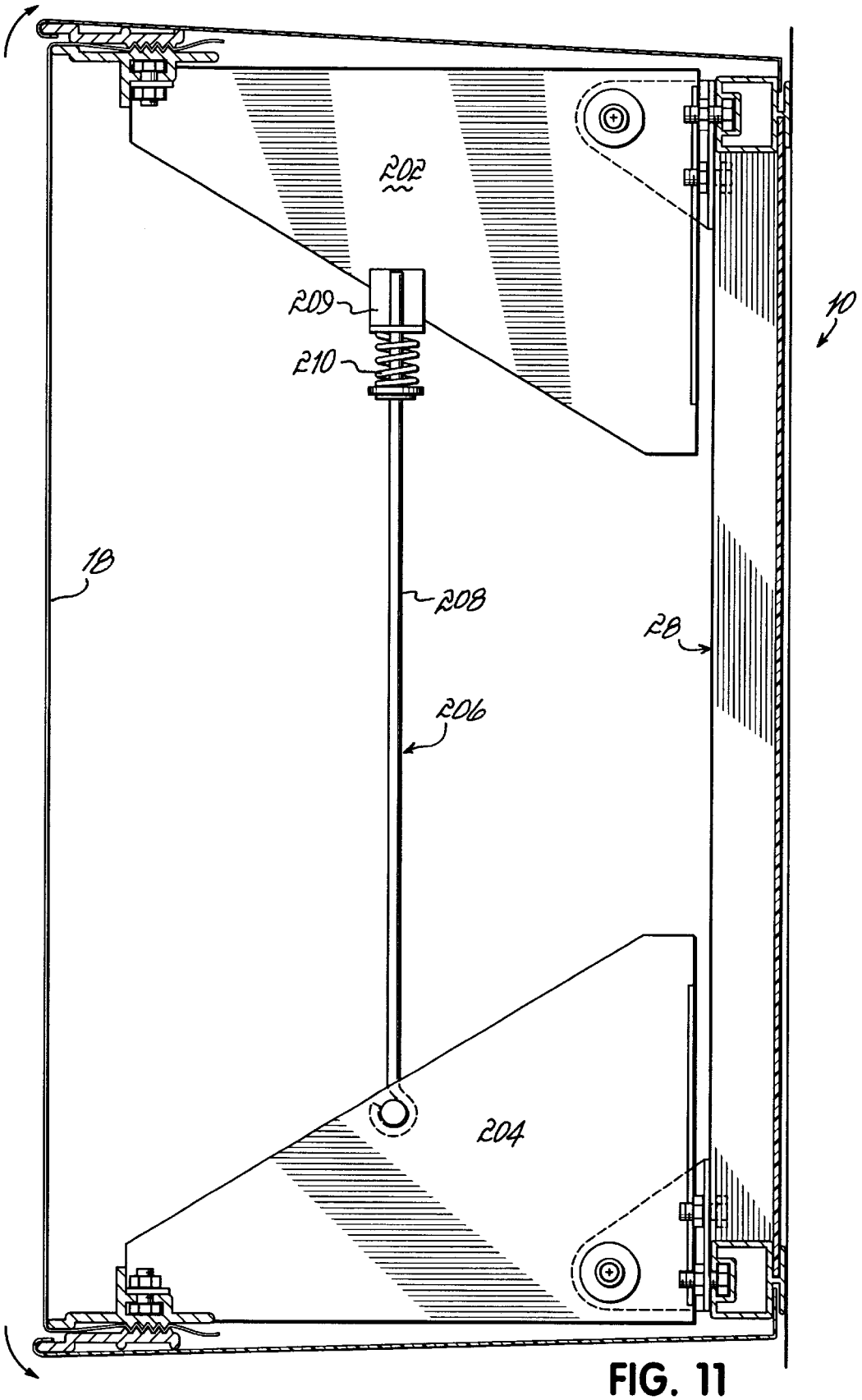
FIG. 11 is a schematic cross-sectional view of another embodiment of the fascia tensioning mechanism of the sign frame assembly.

With reference to FIG. 11, the sign frame assembly 10 is shown with upper and lower pivotally mounted brackets 202, 204. A bias member 206 is connected between the upper and lower pivotally mounted brackets 202, 204 to exert a rotational force on both the upper and lower pivotally mounted brackets 202, 204 to tension the flexible fascia 18. The bias member 206 includes a rigid rod 208 slidably mounted in bracket 209 and a compression spring 210 resiliently held between the bracket 209 and the rigid rod 208. Accordingly, the compression spring 210 forces the rigid rod 208 to slide through the bracket 209 causing the upper and lower pivotally mounted brackets 202, 204 to rotate in a direction tending to tension the flexible fascia 18.

Figure 12:
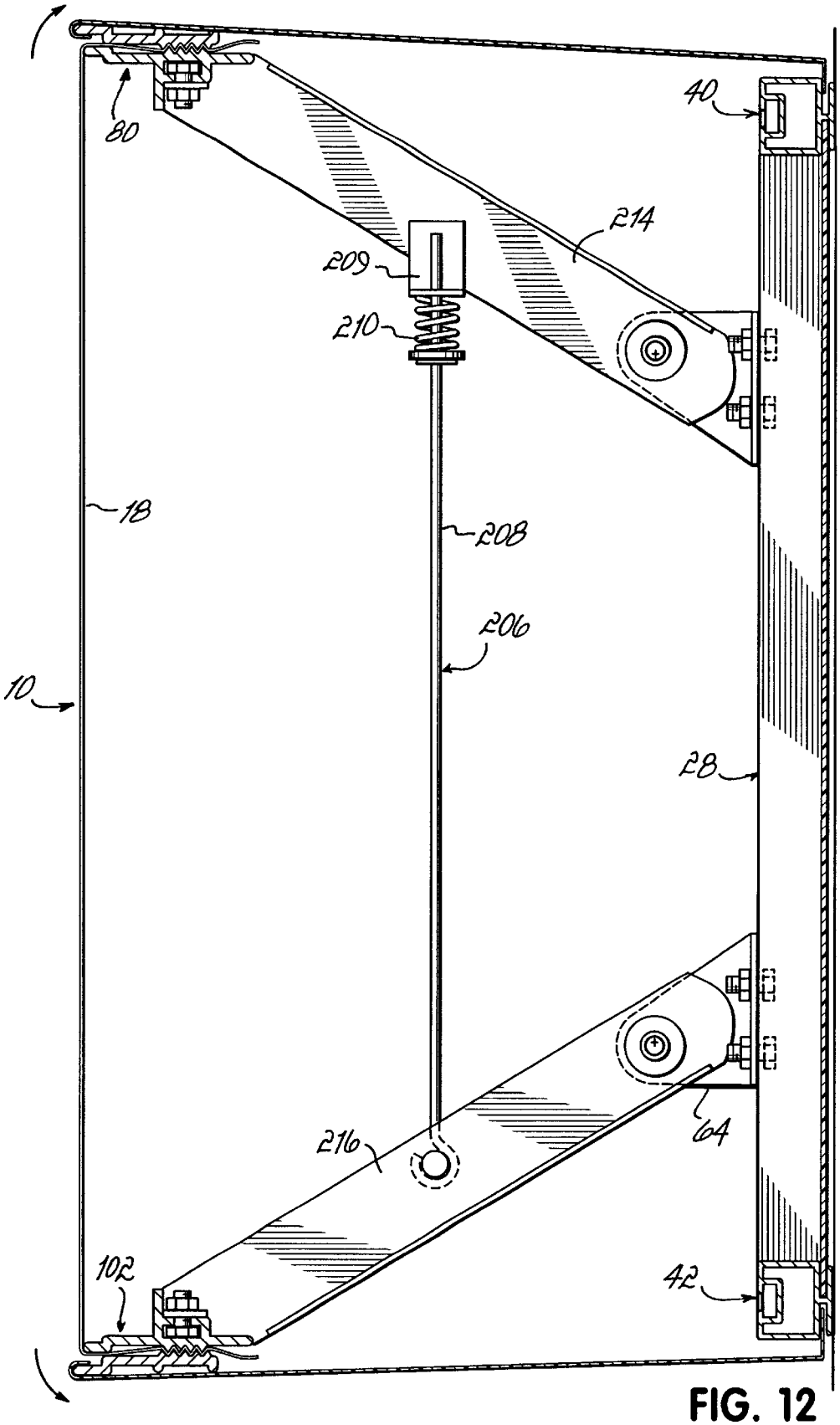
FIG. 12 is a schematic cross-sectional view of another embodiment of the fascia tensioning mechanism of the sign frame assembly.

The embodiment shown in FIG. 12 has a similar configuration to the embodiment shown in FIG. 11. Specifically, the bias member 206 of FIG. 11 is also used in this embodiment to engage upper and lower pivotally mounted arms 214, 216 having relocated pivot points compared to upper and lower brackets 202, 204 (FIG. 11). The compression spring 210 forces the rigid rod 208 to slide through the bracket 209 thereby exerting a rotational force on the upper and lower pivotally mounted arms 214, 216 to tension the flexible fascia 18. It can be appreciated that in both the embodiments of FIGS. 11 and 12, one of the brackets 202, 204 or arms 214, 216 could be fixedly mounted, i.e., nonpivoting, leaving only one of the brackets to pivot in response to the bias member 206.

Figure 13:
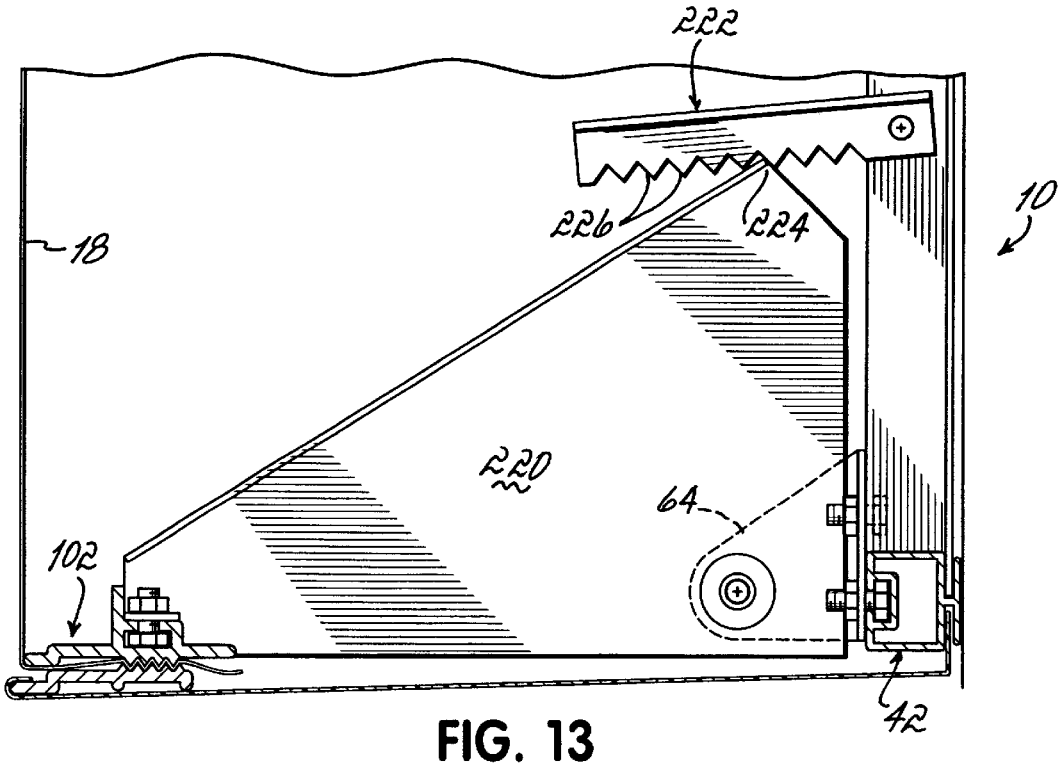
FIG. 13 is a schematic cross-sectional view of another embodiment of the fascia tensioning mechanism of the sign frame assembly.

With reference to FIG. 13, the sign frame assembly 10 is shown with a lower pivotally mounted bracket 220 and a biasing ratchet member 222. During the installation of the sign frame assembly 10, the lower bracket 220 is rotated such that its upper edge 224 engages teeth 226 of the biasing ratchet member 222. Accordingly, the lower bracket 220 is held in a rotated position by the biasing ratchet member 222 yielding a tensioned flexible fascia 18. It can be appreciated that the biasing ratchet member 222 could also be used on a pivoting upper bracket to provide an additional means for tensioning the flexible fascia 18.

Figure 14A:
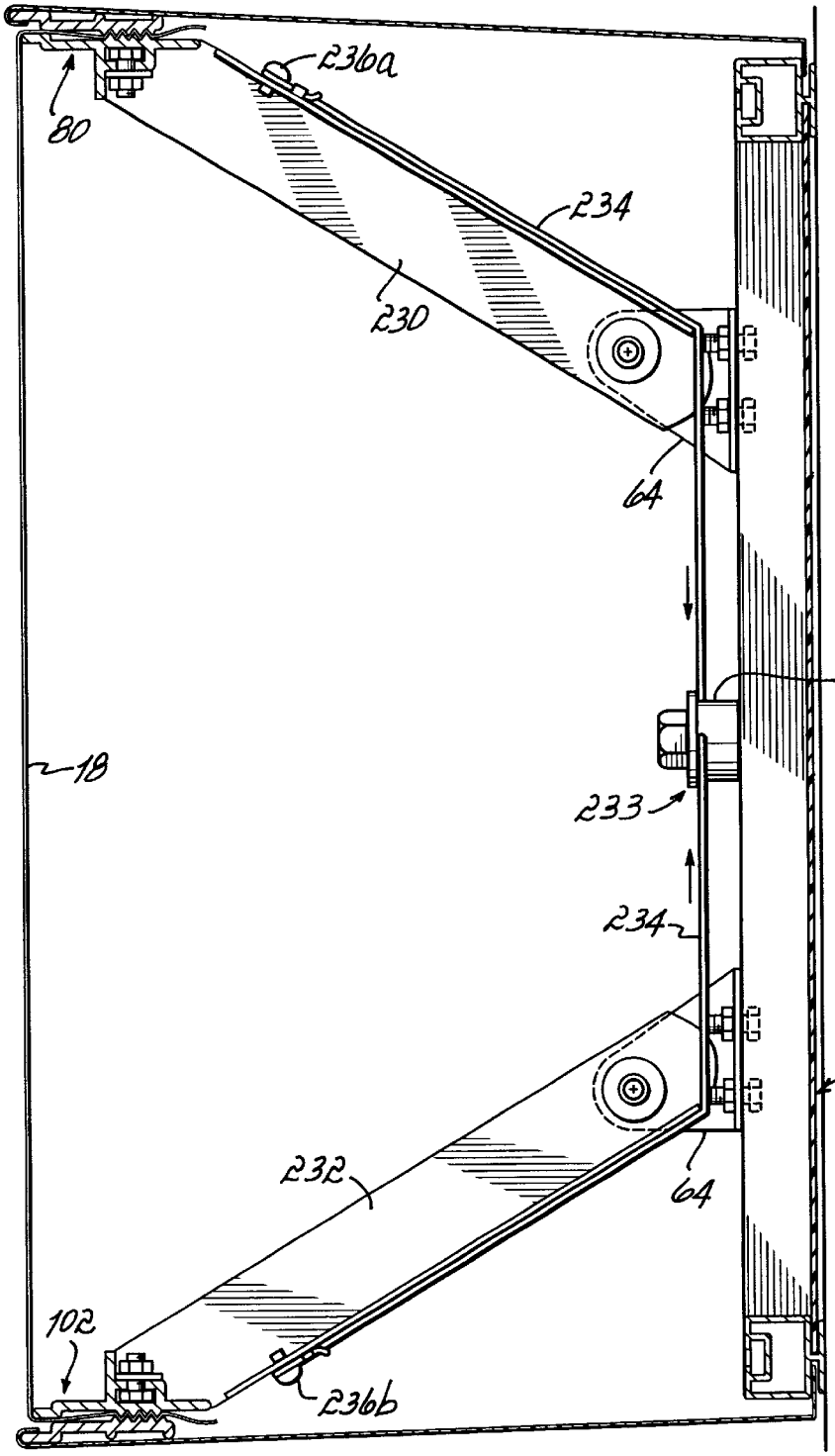
FIGS. 14A and 14B are schematic cross-sectional views of another embodiment of the fascia tensioning mechanism of the sign frame assembly.
Figure 14B:
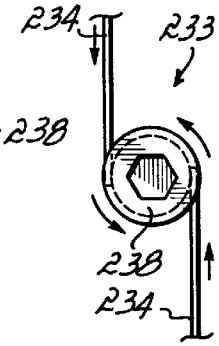

With reference to FIGS. 14A and 14B, the sign frame assembly 10 includes upper and lower pivotally mounted arms 230, 232. A bias member 233 includes a cable 234 connected respectively to rivets or screws 236*a*, 236*b* secured to upper and lower arms 230, 232. The bias member 233 further includes a rotational ratchet wheel 238 which, when rotated, winds up the cable 234 around the rotational ratchet wheel 238. Accordingly, the length of the biasing cable 234 is shortened which tends to pivot or rotate the upper and lower arms 230, 232. As such, the upper and lower pivoting arms 230, 232 spread apart and tension the flexible fascia 18. Once the ratchet wheel 238 tightens the cable 234, the cable 234 applies a continuous bias force to the upper and lower arms 230, 232 which tends to rotate the upper and lower arms 230, 232 in a direction tending to tension the flexible fascia 18. It can be appreciated that the ratchet wheel 238 could be spring loaded, so as to continuously tension the cables 234 and rotate the lower arms 230, 232 outwardly.

Figure 15:
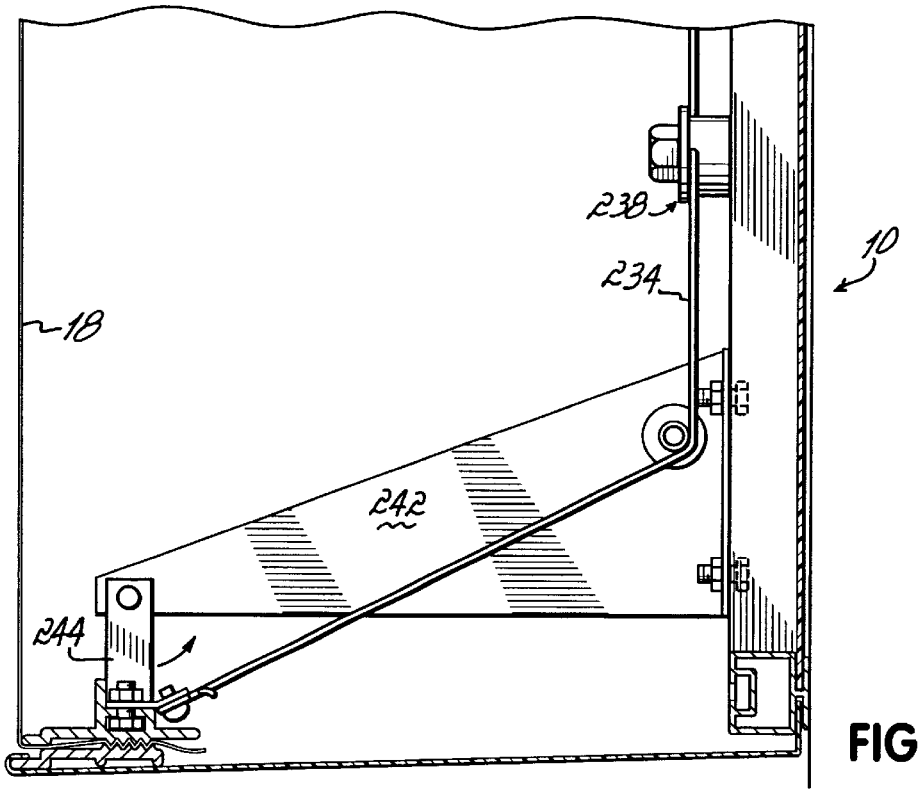
FIG. 15 is a schematic cross-sectional view of another embodiment of the fascia tensioning mechanism of the sign frame assembly.

With reference to FIG. 15, the sign frame assembly 10 is shown with a lower stationary bracket 242 with a tensioning member 244 pivotally mounted to the outer end of the lower stationary bracket 242. Using the bias member 233, as shown and described in FIGS. 14A and 14B, one end of the biasing cable 234 is connected to the tensioning member 244. Once the ratchet wheel 238 tightens the cable 234, the cable 234 applies a continuous bias force to the tensioning member 244 so as to apply tension to the flexible fascia 18. As can be appreciated, the tensioning scheme shown for the lower stationary bracket 242 and the tensioning member 244 could also be used on the upper portion of the sign frame assembly 10.

With reference to FIGS. 16A–C, the sign frame assembly 10 is shown with a lower pivotally mounted bracket 248 and a bias member 250. The bias member 250 includes a fixed rod 252 upon which a biasing wedge 254 can slide thereupon. The biasing wedge 254 has a camming surface 256 which engages the upper edge 257 of the lower bracket 248.

As the biasing wedge 254 moves downward on the fixed rod 252, the camming surface 256 exerts a rotational force on the lower bracket 248 in a direction tending to tension the flexible fascia 18. As can be appreciated, there are several ways in which the biasing wedge 254 can be forced down the fixed rod 252 so as to rotate the lower pivoting bracket 248. Accordingly and with reference to FIG. 16B, a spring member 258 is coaxially aligned with the fixed rod 252 and is inserted between the top surface of the biasing wedge 254 and a fixed nut and washer 260. The spring 258 forces the biasing wedge 254 downward on fixed rod 252 so that the camming surface 256 tends to exert a rotational force on the lower pivoting bracket 248 in a direction tending to tension the flexible fascia 18. With reference to FIG. 16C, the fixed rod 252 can be a threaded rod onto which a nut 262 is threaded. As the nut 262 is tightened upon the threaded fixed rod 252, the camming surface 256 of the biasing wedge 254 exerts a rotational force on the lower pivoting bracket 248 tending to tension the flexible fascia 18. The biasing wedge 254 could also be held in place by ratcheting teeth on the fixed rod 252 such that when the biasing wedge 254 is pushed downwardly on the fixed rod 252, it will remain in a fixed position without requiring a spring or nut to hold it in place. As can be appreciated, a bias member 250 could also be employed on an upper pivotally mounted bracket.

With reference to FIGS. 17A and 17B, the sign frame assembly 10 is shown with a fixedly mounted lower bracket 266 and a pivotal tensioning member 268 to which one edge of the flexible fascia 18 is attached. The pivotal tensioning member 268 includes a pivot member 270 which engages the lower bracket 266 such that the tensioning member 268 can pivot about the pivot member 270 like a fulcrum. A bolt 272 connected between the lower bracket 266 and the tensioning member 268 can be tightened to cause the tensioning member 268 to pivot about the pivot member 270 and thereby apply tension to the flexible fascia 18. A slight variation is shown in FIG. 17B in which a spring 273 is placed between a flange portion 274 of the lower bracket 266 and the head of the bolt 272. As such, the spring continually provides a rotational force to pivot the tensioning member 268 such that the flexible fascia 18 is tensioned.

With reference to FIG. 18, the sign frame assembly 10 includes upper and lower fixedly mounted brackets 276, 278 and upper and lower pivotally mounted brackets. A bias member 284 is connected between the upper and lower pivotally mounted brackets 280, 282. The bias member 284 could be a tension spring or a turn buckle. As such, the bias member 284 applies a rotational force on the upper and lower pivotally mounted brackets 280, 282 in a direction tending to tension the flexible fascia 18. It can be appreciated that one of the brackets 280, 282 could be held fixedly mounted and the biasing member 284 would rotate only one of the pivotally mounted brackets 280 or 282. Even with only one of the brackets 280, 282, pivoting, the bias member 284 would still tension the flexible fascia 18. Once the turn buckle is tightened, it exerts a continuous bias force on the upper and lower pivoting brackets 280, 282.

With reference to FIG. 19, the sign frame assembly 10 includes a lower pivotally mounted arm 288 and an over-center bias mechanism 290. With the over-center bias mechanism 290 in its active position, it exerts a rotational force on the lower arm 288 in a direction tending to tension the flexible fascia 18. Once the over-center bias mechanism 290 is locked in the extended position, it will exert a continuous biasing force onto the lower arm 288. It can be appreciated that an additional over-center bias mechanism could be employed on an upper pivotally mounted arm to also tension the flexible fascia 18.

The embodiment shown in FIG. 20 is similar to that shown in FIG. 19. In this embodiment, an over-center bias mechanism 298 engages upper and lower pivotally mounted arms 294, 296. When the over-center bias mechanism 298 is in its active position, it exerts a rotational force on the upper and lower arms 294, 296 in a direction tending to tension the flexible fascia 18.

With reference to FIG. 21, the sign frame assembly 10 includes a pivotally mounted lower bracket 302 and a bias member 304 such as a tension spring. The bias member or tension spring 304 is connected between a fixed bracket 306 and the pivotally mounted lower bracket 302, such that it exerts a rotational force on the lower pivot bracket 302 in a direction tending to tension the flexible fascia 18. As can be appreciated, this configuration could also be used on an upper pivotally mounted bracket so that both upper and lower brackets pivot to tension the flexible fascia 18.

While the present invention has been illustrated by a description of various preferred embodiments and while these embodiments have been described in considerable detail in order to describe the best mode of practicing the invention, it is not the intention of Applicant to restrict or in any way limit the scope of the appended claims to such detail. Additional advantages and modifications within the spirit and scope of the invention will readily appear to those skilled in the art.

The invention itself should only be defined by the appended claims, wherein we claim:

1. A sign frame assembly for supporting a flexible fascia, comprising:

first and second spaced apart frame members each extending in a first direction, each frame member having first and second bracket mounting sections spaced apart from each other in said first direction;

first and second brackets, each bracket having inner and outer opposite ends, respective inner ends of said first and second brackets being attached to said first bracket mounting sections of said first and second frame members;

third and fourth brackets, each bracket having inner and outer opposite ends, respective inner ends of said third and fourth brackets being pivotally attached to said second bracket mounting sections of said first and second frame members;

first and second transverse frame members, said first transverse frame member affixed to and spanning between said inner ends of said first and second brackets, said second transverse frame member affixed to and spanning between said inner ends of said third and fourth brackets;

first and second elongated members, said first elongated member affixed to and spanning between said outer ends of said first and second brackets, said second elongated member affixed to and spanning between said outer ends of said third and fourth brackets;

a flexible fascia having oppositely disposed edges connected to said first and second elongated members; and a bias member operatively connected to each of said first and second frame members and each of said third and fourth brackets, said bias member exerting a rotational force on said third and fourth brackets in a direction tending to spread apart said first and second elongated members and tension said flexible fascia therebetween.

2. The sign frame assembly of claim 1 wherein each of said first and second elongated members include first and second fascia-clamping members clampingly engaging respective oppositely disposed edges of said flexible fascia.

3. The sign frame assembly of claim 2 wherein said first and second fascia-clamping members each have a pair of confronting surfaces between which said edges of said flexible fascia are insertable for engagement by said confronting surfaces and positively held therebetween.

4. The sign frame assembly of claim 1 wherein each of said first and second elongated members includes a formed channel, said formed channel is adapted to receive a splicing plate.

5. The sign frame assembly of claim 1 wherein said bias member is a compression member.

6. The sign frame assembly of claim 1 wherein said bias member is a tension member.

7. The sign frame assembly of claim 1 wherein at least one of said first and second elongated members has an elongated recess with an opening along the length of the recess and a rod contained within said recess, an edge of said flexible fascia being disposed in said opening and attached to said rod such that said edge is held by said rod in said recess.

8. The sign frame assembly of claim 1 further comprising:

a protective cover placed over the sign assembly to protect the sign assembly from liquid ingress, said protective cover includes an outer lip extending outwardly beyond the exterior of said flexible fascia to cause liquid incident to the exterior of said cover to drip from said outer lip at a point spaced outwardly from the exterior of said flexible fascia.

9. The sign frame assembly of claim 1 wherein said first and second frame members and said first and second transverse frame members have formed slots along their respective lengths, said slots being adapted to receive and retain a cover member.

10. The sign frame assembly of claim 1 further comprising:

an illumination source contained within the sign assembly for illuminating said flexible fascia from the interior of side thereof.

11. A sign frame assembly for supporting a flexible fascia, comprising:

first and second spaced apart frame members each extending in a first direction, each frame member having first and second bracket mounting sections spaced apart from each other in said first direction;

first and second brackets, each of said first and second brackets having inner and outer opposite ends, said inner end of said first bracket being attached to said first bracket-mounting section of said first frame member, said inner end of said second bracket being pivotally mounted to said second bracket-mounting section of said first frame member;

third and fourth brackets, each of said third and fourth brackets having inner and outer opposite ends, said inner end of said third bracket being attached to said first bracket-mounting section of said second frame member, said inner end of said fourth bracket being pivotally mounted to said second bracket-mounting section of said second frame member;

first and second fascia attachment members, said first fascia attachment member connected to and extending between said outer ends of said first and third brackets, said second fascia attachment member connected to and extending between said outer ends of said second and fourth brackets;

a flexible fascia having oppositely disposed edges connected to said first and second fascia attachment members; and a bias member operatively connected to said first frame member and said second bracket, said bias member exerting a rotational force on said second bracket in a direction tending to spread apart said fascia attachment members and tension said flexible fascia therebetween.

12. The sign frame assembly of claim 11, wherein each of said first and second fascia attachment members is elongated and includes first and second fascia-clamping members clampingly engaging said oppositely disposed edges of said flexible fascia.

13. The sign frame assembly of claim 12, wherein said first and second fascia-clamping members each have a pair of confronting surfaces between which said edges of said flexible fascia are insertable for engagement by said confronting surfaces and positively held therebetween.

14. The sign frame assembly of claim 11, wherein each of said first and second fascia attachment members is elongated and has a formed channel, said formed channel adapted to receive a splicing plate.

15. The sign frame assembly of claim 11, wherein said bias member is a compression member.

16. The sign frame assembly of claim 11, wherein said bias member is a tension member.

17. The sign frame assembly of claim 11, wherein at least one of said first and second fascia attachment members is elongated and has an elongated recess with an opening along the length of the recess and a rod contained within said recess, an edge of said flexible fascia being disposed in said opening and attached to said rod such that said edge is held by said rod in said recess.

18. The sign frame assembly of claim 11 further comprising:

a protective cover placed over the sign assembly to protect the sign assembly from liquid ingress, said protective cover includes an outer lip extending outwardly beyond the exterior of said flexible fascia to cause liquid incident on the exterior of said protective cover to drip from said outer lip at a point spaced outwardly from the exterior of said flexible fascia.

19. The sign frame assembly of claim 11, wherein said inner end of said first bracket is fixedly attached to said first bracket-mounting section of said first frame member.

20. A tensioned fascia apparatus, comprising:

a flexible fascia having first and second opposite edges;

first and second spaced apart attachment members, each attachment member being connected to said first edge of said fascia to resist movement of said first fascia edge toward said second fascia edge;

first and second spaced apart tensioning members, each tensioning member having a pivotally mounted inner end and an outer section connected to said second edge of said flexible fascia; and a bias member connected to said first tensioning member and exerting a rotational force on said first tensioning member in a direction tending to tension said flexible fascia in a direction perpendicular to said first and second edges of said flexible fascia.

21. The tensioned fascia apparatus of claim 20 wherein said first attachment member includes a third tensioning member, said first and third tensioning members include respective first and second extension arms, said bias member is a compression spring resiliently engaging said first and second extension arms to exert a rotational force on said first and third tensioning members in a direction tending to tension the flexible fascia.

22. The tensioned fascia apparatus of claim 20 wherein said first attachment member includes a third tensioning member, said bias member is a leaf spring connected between said first and third tensioning members to exert a rotational force on said first and third tensioning members in a direction tending to tension said flexible fascia.

23. The tensioned fascia apparatus of claim 20 wherein the bias member is a torsion spring.

24. The tensioned fascia apparatus of claim 20 wherein said first attachment member includes a third tensioning member, and said bias member includes a compression spring operatively connected to a rigid rod spanning between said first and third tensioning members such that said compression spring exerts a rotational force on said first and third tensioning members in a direction tending to tension said flexible fascia.

25. The tensioned fascia apparatus of claim 20 wherein said bias member is a bias ratchet member having teeth engaging an upper edge of said first tensioning member such that said bias ratchet member exerts a rotational force on said first tension member in a direction tending to tension said flexible fascia.

26. The tensioned fascia apparatus of claim 20 wherein said first attachment member includes a third pivotally mounted tensioning member and said bias member includes a ratchet wheel and a cable affixed to said first and third tensioning members such that when said ratchet wheel is rotated, said cable exerts a rotational force on said first and third tensioning members in a direction tending to tension said flexible fascia.

27. The tensioned fascia apparatus of claim 20 wherein said tensioning member is pivotally mounted to a fixedly mounted bracket, and wherein said bias member includes a ratchet wheel and a cable, such that when said ratchet wheel is rotated said cable exerts a rotational force on said tensioning member in a direction tending to tension said flexible fascia.

28. The tensioned fascia apparatus of claim 20 wherein said bias member includes a rigid rod and a slidably mounted biasing wedge having a camming surface, said camming surface engages said first tensioning member when said biasing wedge is slid along said rigid rod and exerts a rotational force on said first tensioning member in a direction tending to tension said flexible fascia.

29. The tensioned fascia apparatus of claim 20 wherein said first tensioning member includes a pivot member engaging a fixedly mounted bracket, said first tensioning member being engaged by a threaded member such that when said threaded member is tightened, said biasing member rotates in a direction tending to tension said flexible fascia.

30. The tensioned fascia apparatus of claim 20 wherein said first attachment member includes a third tensioning member which is pivotally mounted to the first attachment member and said bias member is a tension spring connected between said first and third tensioning members to exert a rotational force on said first and third tensioning members in a direction tending to tension said flexible fascia.

31. The tensioned fascia apparatus of claim 20 wherein said bias member is a turn buckle such that when said turn buckle is tightened it exerts a rotational force on said first and second tensioning members in a direction tending to tension said flexible fascia.

32. The tensioned fascia apparatus of claim 20 wherein said bias member is an over-center bias mechanism which exerts a rotational force on said first tensioning member in a direction tending to tension said flexible fascia.

33. The tensioned fascia apparatus of claim 20 wherein said first attachment member includes a third tensioning member pivotally connected thereto, said bias member is an over-center biasing mechanism connected between said first and third tensioning members and exerting a rotational force on said first and second tensioning members in a direction tending to tension said flexible fascia.

34. The tensioned fascia apparatus of claim 20 wherein said bias member is a tension spring.

35. The sign frame assembly of claim 20, wherein each of said first and second attachment members and each of said first and second bias members includes first and second fascia-clamping members clampingly engaging respective edges of said flexible fascia.

36. The sign frame assembly of claim 35, wherein said first and second fascia-clamping members each have a pair of confronting surfaces between which said edges of said flexible fascia are insertable for engagement by said confronting surfaces and positively held therebetween.

37. The sign frame assembly of claim 20, wherein each of said first and second fascia attachment members is elongated and has a formed channel, said formed channel adapted to receive a splicing plate.

38. The sign frame assembly of claim 20, wherein said bias member is a compression member.

39. The sign frame assembly of claim 20, wherein said bias member is a tension member.

40. The sign frame assembly of claim 20 further comprising:

a protective cover placed over the sign assembly to protect the sign assembly from liquid ingress, said protective cover includes an outer lip extending outwardly beyond the exterior of said flexible fascia to cause liquid incident on the exterior of said protective cover to drip from said outer lip at a point spaced outwardly from the exterior of said flexible fascia.

41. A sign frame assembly for supporting a flexible fascia, comprising:

a first frame member extending in a first direction and having first and second bracket-mounting sections spaced apart from each other in said first direction;

first and second brackets, each bracket having inner and outer opposite ends, said inner end of said first bracket being attached to said first bracket-mounting section of said first frame member, said inner end of said second bracket being pivotally mounted to said second bracket-mounting section of said first frame member;

first and second fascia attachment members connected respectively to said outer ends of said first and second brackets;

a flexible fascia having oppositely disposed edges connected to said first and second fascia attachment members;

a bias member operatively connected to said first frame member and said second bracket, said bias member exerting a rotational force on said second bracket in a direction tending to spread apart said fascia attachment members and tension said flexible fascia therebetween; and an illumination source contained within the sign frame assembly for illuminating said flexible fascia from the interior side thereof.

* * * * *

UNITED STATES PATENT AND TRADEMARK OFFICE

CERTIFICATE OF CORRECTION

PATENT NO. : 6,370,802 B1
DATED : April 16, 2002
INVENTOR(S) : John D. Boyer et al.

It is certified that error appears in the above-identified patent and that said Letters Patent is hereby corrected as shown below:

Title page,
Add item -- [73] Assignee: LSI Industries Inc., Cincinnati, Ohio (USA) --.

Signed and Sealed this

Twenty-fifth Day of November, 2003

JAMES E. ROGAN
*Director of the United States Patent and Trademark Office*